US010273892B2

(12) United States Patent
Miyazaki et al.

(10) Patent No.: US 10,273,892 B2
(45) Date of Patent: Apr. 30, 2019

(54) FUEL SUPPLY SYSTEM FOR AN INTERNAL COMBUSTION ENGINE

(71) Applicants: AISAN KOGYO KABUSHIKI KAISHA, Obu-shi, Aichi-ken (JP); TOYOTA JIDOSHA KABUSHIKI KAISHA, Toyota-shi, Aichi-ken (JP)

(72) Inventors: Ryuji Miyazaki, Kariya (JP); Hidetoshi Tsutsumi, Kakamigahara (JP); Tomonori Nakatsuka, Nissin (JP); Kinji Morihiro, Toyota (JP); Koji Honda, Toyota (JP)

(73) Assignees: AISAN KOGYO KABUSHIKI KAISHA, Obu-shi, Aichi-Ken (JP); TOYOTA JIDOSHA KABUSHIKI KAISHA, Toyota-shi, Aichi-Ken (JP)

( * ) Notice: Subject to any disclaimer, the term of this patent is extended or adjusted under 35 U.S.C. 154(b) by 502 days.

(21) Appl. No.: 14/794,998

(22) Filed: Jul. 9, 2015

(65) Prior Publication Data

US 2016/0010570 A1 Jan. 14, 2016

(30) Foreign Application Priority Data

Jul. 10, 2014 (JP) ..... 2014-142144

(51) Int. Cl.
*F02D 41/00* (2006.01)
*F02M 61/14* (2006.01)
*F02M 25/08* (2006.01)

(52) U.S. Cl.
CPC ..... *F02D 41/004* (2013.01); *F02D 41/0042* (2013.01); *F02M 25/089* (2013.01);
(Continued)

(58) Field of Classification Search
CPC ..... F02D 41/004; F02D 41/0042; F02D 2200/0406; F02M 25/0836; F02M 25/089; F02M 61/145
(Continued)

(56) References Cited

U.S. PATENT DOCUMENTS 5,535,719 A 7/1996 Morikawa et al.
5,758,631 A * 6/1998 Teraoka ..... F02D 41/0045 123/674

(Continued)

FOREIGN PATENT DOCUMENTS

DE 4436312 A1 4/1995
DE 102009008831 A1 8/2010

(Continued)

OTHER PUBLICATIONS

U.S. Appl. No. 14/795,018 Office Action dated Dec. 16, 2016 (20 pages).

(Continued)

*Primary Examiner* — David E Hamaoui
*Assistant Examiner* — Susan E Scharpf
(74) *Attorney, Agent, or Firm* — Conley Rose, P.C.

(57) ABSTRACT

A fuel supply system for use with an internal combustion engine has a check valve and a purge valve disposed in a purge passage that extends from a canister to connect with an intake passage of the internal combustion engine. A controller regulates the purge valve open with a first opening degree or a first duty ratio during a purge operation. The controller may also regulate the purge valve to open with a second opening degree larger than the first opening degree or a second duty ratio larger than the first duty ratio a predetermined time after initiating the purge operation.

8 Claims, 16 Drawing Sheets

(52) U.S. Cl.
CPC ..... *F02M 25/0836* (2013.01); *F02M 61/145* (2013.01); *F02D 2200/0406* (2013.01)

(58) Field of Classification Search
USPC ..... 123/445
See application file for complete search history.

(56) References Cited

U.S. PATENT DOCUMENTS

| | | | | |
|---|---|---|---|---|
| 6,079,393 | A | 6/2000 | Tsutsumi et al. | |
| 6,305,361 | B1 | 10/2001 | Takaku et al. | |
| 7,334,559 | B2 | 2/2008 | Osanai | |
| 2007/0163536 | A1 | 7/2007 | Okubo et al. | |
| 2010/0223984 | A1 | 9/2010 | Pursifull et al. | |
| 2011/0132331 | A1* | 6/2011 | Pursifull | F02B 37/127 123/478 |
| 2011/0265768 | A1* | 11/2011 | Kerns | F02M 25/08 123/521 |
| 2011/0295482 | A1* | 12/2011 | Pearce | B60K 15/03504 701/102 |
| 2012/0247434 | A1 | 10/2012 | Shimura et al. | |
| 2014/0102420 | A1 | 4/2014 | Kimoto et al. | |
| 2014/0345574 | A1 | 11/2014 | Haefele | |

FOREIGN PATENT DOCUMENTS

| | | | |
|---|---|---|---|
| DE | 102011084403 | A1 | 4/2013 |
| DE | 102013016984 | A1 | 4/2014 |
| JP | H06101517 | A | 4/1994 |
| JP | H11-062729 | A | 3/1999 |
| JP | 2000-045886 | A | 2/2000 |
| JP | 2002188528 | A | 7/2002 |
| JP | 2006-057596 | A | 3/2006 |
| JP | 2007-198353 | A | 8/2007 |

OTHER PUBLICATIONS

U.S. Appl. No. 14/795,018 Response to Office Action dated Dec. 16, 2016 filed Mar. 15, 2017 (10 pages).
Japanese Office Action dated Aug. 24, 2017, for Japanese Application No. 2014-142144 (3 p.).
English Translation of Japanese Office Action dated Aug. 24, 2017, for Japanese Application No. 2014-142144 (3 p.).
German Patent Application No. 102015008902.1 Office Action dated Oct. 14, 2015 (6 pages).
German Office Action dated Jul. 25, 2018, for German Application No. 102015008889.0 (8 p.).
English Translation of German Office Action dated Jul. 25, 2018, for German Application No. 102015008889.0 (4 p.).

* cited by examiner

FUEL SUPPLY SYSTEM FOR AN INTERNAL COMBUSTION ENGINE

CROSS-REFERENCE TO RELATED APPLICATIONS

This application claims the benefit of priority to Japanese Patent Application Serial No. 2014-142144 filed on Jul. 10, 2014, the contents of which are incorporated herein by reference in their entirety.

STATEMENT REGARDING FEDERALLY SPONSORED RESEARCH OR DEVELOPMENT

Not applicable.

BACKGROUND

Embodiments of the present disclosure generally relate to fuel vapor supply systems for supplying fuel vapor stored in a canister to an internal combustion engine via an intake and/or purge passage.

Conventionally, as generally referred to and/or known in the art, a vehicle such as an automobile may be powered by an internal combustion engine that consumes fuel to provide power to, for example, a drivetrain of the automobile to propel the automobile as desired (i.e., forward). Such internal combustion engines may be configured to be in fluid communication with one or more canisters configured to store and/or adsorb fuel vapor supplied from a fuel tank to the engine. Specifically, lines and/or passages connecting the fuel tank, canister and/or engine may be open and shut by control valves with, for example, a "purge control" setting and/or mode. Further, the purge control setting may be associated with a predetermined condition such that if the predetermined condition is met during operation of the internal combustion engine, the purge control may be triggered. In detail, purge control may involve the introduction of atmospheric air into the canister. Fuel vapor accumulated and/or stored in the canister may be supplied to the internal combustion engine via an intake pipe to be combusted. Thus, by performing the purge control, the fuel vapor stored in the canister may be combusted without, for example, being first discharged to the atmosphere. Accordingly, as described herein, an internal combustion engine configured with a purge control setting may be used to minimize environmental emissions by regulating discharge of fuel vapor stored in the canister to the surrounding atmosphere.

However, a quantity of fuel supplied to the engine may proportionately increase in accordance with the quantity of fuel supplied from the canister, rather than the quantity of fuel injected into the engine by injectors. For example, should the internal combustion engine, as described above, use a three-way catalyst to purify exhaust gas, a theoretical air fuel ration of $\lambda=1.0$ may be selected to achieve a desirable exhaust gas purification efficiency. Thus, fuel delivery from the injectors and/or the canister may need to be reduced and/or regulated to achieve such a purification efficiency as described. Moreover, delay (i.e., in time) in the arrival of the fuel vapor from the canisters to the internal combustion engine after starting the purge control may influence exhaust gas purification efficiency.

Also, recent developments in the automotive sector have shown that manufacturers are beginning to integrate forced induction and/or other artificial, non-naturally aspirated power enhancement devices to conventional internal combustion engines. Such devices may include supercharges, compressors, turbochargers (i.e., "turbos") and/or any combination of the same. For example, in the case of the internal combustion engine configured with a supercharger, the pressure within the intake pipe may vary between negative and positive (i.e. relative to the outside atmospheric pressure) according to a pre-set supercharger condition and/or setting. Further, interruptions in airflow throughout the intake and/or exhaust system of a vehicle may occur due to backfires, for example, and may produce unwanted pressure variances and/or differentials in a vehicle intake pipe (i.e., an air intake pipe to provide fresh air to the internal combustion engine), even without a supercharger and/or turbocharger etc. For example, should the pressure within the intake pipe be negative (i.e., relative to the outside atmosphere), the fuel vapor within the canister may be drawn (i.e., suctioned) into the internal combustion engine via the intake pipe while the atmospheric air is introduced into the canister. In contrast, should the pressure within the intake pipe be positive, the fuel vapor within the canister may not be drawn into the internal combustion engine, as may be desirable for engine operation. Instead, the intake air may flow into the canister. Therefore, positive pressure within the intake pipe is most often not preferable for the purge control. For this reason, a check valve may be disposed in and/or on a purge passage connecting the canister and the intake pipe to permit and/or regulate flow of fluid in a direction from, for example, a side of the canister to a side of the intake pipe and also may prevent flow of the fluid in the opposite direction to that described. In such a case, a purge valve controlled by a controller may be disposed in and/or on the purge passage at a position on a side of the canister, and the check valve may be disposed in and/or on the purge passage at a position on a side of the intake pipe.

For example, Japanese Laid-Open Patent Publication No. 2006-57596 discloses a fuel vapor supply system with a purge valve disposed in and/or on a purge passage connecting a canister to an intake pipe at a position on a side of the canister. In detail, a check valve is disposed in and/or on the purge passage at a position on a side of the intake pipe. The fuel vapor supply system disclosed in Japanese Laid-Open Patent Publication No. 2006-57596 is generally configured such that vaporized fuel stored in the canister is supplied to the engine to improve cold start performance of the engine. Further, since the check valve, as described herein, is disposed in the purge passage, potential damage caused by, for example, a backfire may be avoided.

Also, Japanese Laid-Open Patent Publication No. 2007-198353 generally discloses a fuel vapor supply system for an engine with a supercharger. In detail, a purge valve is disposed in and/or on a purge passage connecting a canister and an intake pipe at a position on a side of the canister, and a check valve is disposed in and/or on the purge passage at a position on a side of the intake pipe. In the system disclosed by Japanese Laid-Open Patent Publication No. 2007-198353, the purge valve is opened at a predetermined time after stopping of the engine to, for example, avoid creating a residual negative pressure, i.e., a lower pressure in comparison to atmospheric pressure, within a part of the purge passage extending between the purge valve and the check valve. Accordingly, operational difficulties associated with such a residual negative pressure within the purge passage may be avoided.

Further, as initially described in Japanese Laid-Open Patent Publication No. 2007-198353, should the purge valve be disposed in and/or on the purge passage on a side of the canister, while the check valve is disposed in and/or on the purge passage on a side of the intake pipe, negative pressure may remain within part of the purge passage that extends between the purge valve and the check valve hereinafter referred to as the "intermediate purge passage." On the condition that the purge valve is fully closed, the check valve may be opened if the pressure within the intake pipe is lower than the pressure within the intermediate purge passage. Thus, the pressure within the intermediate purge passage and the pressure within the intake pipe may equal each other. Alternatively, the check valve may be closed if the pressure within the intake pipe is not lower than the pressure within the intermediate purge passage. As a result, the pressure within the intermediate passage may be uniformly maintained.

Negative pressure, i.e. residual negative pressure, relative to atmospheric conditions, may be noticed both during vehicle (and engine) operation as well at rest (i.e. complete engine deactivation). For instance, should negative pressure, as described here and above, remain in the intermediate purge passage, purge control may be performed to open the purge valve. However, the check valve may remain closed, i.e. may not be opened, until the pressure within the intermediate purge passage increases to exceed the pressure within the intake pipe by air introduced into the canister. In detail, negative pressure within the intake pipe may cause the fuel vapor to be drawn into the canister after the check valve is opened. Thus, there may be a delay until the check valve is opened after the purge valve is opened. Such a delay may cause an increase in the time (i.e. delay time) necessary for the fuel vapor to arrive at the internal combustion engine after leaving the canister. As a result, if the fuel injection quantity of the injectors is reduced without adequately considering the increase of the delay time due to the aforementioned time lag, the reduction in the fuel injection quantity of the injectors may take place sometime before the arrival of the fuel vapor at the internal combustion engine. Thus, the quantity of the fuel may be insufficient relative to the quantity of the intake air, resulting an unfavorable lean condition (i.e., an air excessive condition) in comparison with the theoretical air-fuel ratio condition.

In view of that presented and discussed above, there is a need in the art for an apparatus and/or a system that may minimize unwanted fluctuation in the air-fuel ratio during purge control.

SUMMARY

A fuel vapor supply system configured to supply fuel to an internal combustion engine with an intake passage and a fuel injector is provided. The fuel vapor supply system may include a canister configured to store and/or adsorb fuel vapor, a purge passage in fluid communication with the canister, a purge valve, a check valve and a controller configured to regulate and/or control fuel flow throughout the system. In detail, the canister may store accumulated fuel vapor and the purge passage may connect the canister to an intake passage to allow fuel vapor stored in the canister to travel to the internal combustion engine via the purge passage. In detail, the purge valve and the check valve may be disposed in and/or on the purge passage. The purge valve may open and close the purge passage to regulate and/or control a flow rate of the fuel vapor flowing from the canister to the intake passage. The check valve may be disposed in and/or on the purge passage at a position between the purge valve and the intake passage. The check valve may permit the flow of the fuel vapor from a side of the canister to a side of the intake passage and may also prevent the flow of air from a side of the intake passage to a side of the canister. The purge passage may include an intermediate purge passage extending between the purge valve and the check valve. The controller may be coupled to the purge valve and the fuel injector and be configured to control a degree of opening, i.e. a first degree of opening, of the purge valve and/or a duty ratio, i.e. a first duty ratio that corresponds to a valve opening time compared against a predetermined frequency period such that the flow rate of the fuel vapor flowing across the purge valve may be regulated as desired. In addition, the controller may perform a purge control operation, i.e. hereinafter referred to as "purge control," and/or a reduction control operation, i.e. hereinafter referred to as "reduction control," to regulate and/or reduce a fuel injection quantity of fuel injected from the injector. In detail, the purge control may control the purge valve to open with a first opening degree and/or a first duty ratio, so that the fuel vapor stored in the canister may be supplied from the canister to the internal combustion engine via the purge passage and the intake passage. Specifically, a negative pressure, i.e. pressure lower than surrounding atmospheric pressure, in the intake passage may assist in supplying the fuel vapor from the canister to the internal combustion engine. The fuel vapor may flow across the purge valve through the intermediate purge passage and across the check valve in the purge passage. The reduction control operation may begin when a predetermined arrival delay time has elapsed from starting the purge control, and the reduction control regulates the fuel injector such that a fuel injection quantity of the fuel injector may be reduced and/or adjusted to compensate for variances in the quantity of the fuel vapor supplied to the internal combustion engine.

In one embodiment, the controller may initiate the purge control when a predetermined execution condition is satisfied to control the purge valve. For example, the purge valve may open with a second opening degree larger than the first opening degree, or have a second duty ratio larger than the first duty ratio, all during a predetermined time after starting the purge control, i.e. based on the determination that the predetermined execution condition is satisfied. For example, the purge valve may be opened with the second opening degree and/or the second duty ratio immediately after initiating the purge control or at an appropriate time after initiating the purge control. Thus, any delay in fuel vapor flow resulting from opening and/or closing the purge valve may be regulated and/or shortened, if so desired. Further, the time between when the check valve is opened after the opening of the purge valve may also be shortened. Thus, careful regulation of the opening and closing of the purge valve and/or check valve during a purge operation may allow for the maintenance of pressure between the purge valve and the check valve within a desirable range. Further, unwanted fluctuations of the air-fuel ratio resultant from, for example, negative pressure prevalent in the intermediate purge passage, may be minimized.

The controller may further control the purge valve to open with the second opening degree and/or the second duty ratio from a time when the purge control is initiated.

Alternatively, the controller may control the purge valve to open with the second opening degree and/or the second duty ratio if the pressure within the intermediate purge passage is lower than the pressure within the intake passage when the purge control is initiated.

The controller may further control the purge valve to change the second opening degree to the first opening degree or change the second duty ratio to the first duty ratio when a predetermined time has elapsed after initiating the control of the purge valve for opening with the second opening degree or the second duty ratio. Thus, the first opening degree (or the first duty ratio) may be used as a "normally applied" opening degree (or a "normally applied" duty ratio) where the second opening degree (or the second duty ratio) may be used as a "temporarily applied" opening degree (or a "temporarily applied" duty ratio).

Alternatively, the controller may change the second opening degree to the first opening degree or change the second duty ratio to the first duty ratio when the pressure within the intermediate purge passage becomes higher than the pressure within the intake passage.

Otherwise, the controller may change the second opening degree to the first opening degree or change the second duty ratio to the first duty ratio when a difference between the pressure within the intake passage and the pressure within the intermediate purge passage falls under a predetermined value.

Further, the controller may calculate and/or measure a predetermined "arrival delay" time after a predetermined additional quantity of time from initiating the purge control, should the purge valve be opened with the second opening degree and/or the second duty ration when starting the purge control.

For example, the predetermined additional time as discussed above may be set to correspond to a time lag until the check valve is opened, i.e. after the purge valve is opened. Accordingly, reduction of the quantity of fuel injected by the fuel injectors may be initiated at a time closer to when fuel vapor actually arrives at the engine, to potentially further minimize fluctuation in the air-fuel ratio.

Further, the predetermined "arrival delay" time, as discussed above, may be counted from the time, i.e. the "changing" time, when controller may be reconfigured to change the second opening degree to the first opening degree, or to change the second duty ratio to the first duty ratio.

Alternatively, the controller may count the predetermined "arrival delay" time after a predetermined additional time from initiating the purge control.

In this case, the controller may increase a sum of the predetermined arrival delay time and the predetermined additional time as the difference between a pressure within the intake passage and the pressure within the intermediate purge passage pressure increases.

In another embodiment, the controller may (a) determine whether a predetermined execution condition for the purge control has been met, and (b) predict an "execution condition satisfaction" time when the execution condition for the purge control has been met. The prediction of the "execution condition satisfaction" time, as described herein, may be performed prior to the determination whether the predetermined execution condition has been met. In addition, the controller may determine whether the execution condition satisfaction time has been predicted. This determination may be performed if a result of the execution condition determination indicates that the predetermined execution condition has not been met. Further, the controller may perform a pre-drive operation in which the purge valve is open with the first opening degree or the second opening degree. Specifically, the second opening degree may be larger than the first opening degree and/or the second duty ratio may be larger than the first duty ratio. The pre-drive operation may be performed if a result of the satisfaction determination is that the "execution condition satisfaction" time has been predicted. The pre-drive operation may be initiated at a start time prior to the "execution condition satisfaction" time by a "predetermined pre-drive" time. Further, the controller may control the purge valve to open with the first opening degree or the first duty ratio if a result of the execution condition determination is that the predetermined execution condition has been met.

According to the above-described embodiment, should the prediction have been made that the predetermined execution condition has been met, the purge valve may be opened with the first opening degree (or the first duty ratio) or the second opening degree (or the second duty ratio) prior to initiating the purge control. Thus, variance in pressure within the intake passage and the pressure within the intermediate purge passage may be regulated and/or minimized, if so desired. Hence, it may be possible to shorten a potential time lag between when the check valve is open after the opening of the purge valve to minimize potential fluctuation of the air-fuel ratio.

The controller may detect, calculate and/or determine the "predetermined pre-drive" time based on a difference between the pressure within the intake passage and the pressure within the intermediate purge passage. Thus, the "predetermined pre-drive time" may be determined and/or set to minimize the variance between the pressure within the intake passage and the pressure within the intermediate purge passage.

Further, the controller may terminate the pre-drive operation at a time when the "predetermined pre-drive" time has elapsed, when a difference between a pressure within the intake passage and a pressure within the intermediate purge passage falls beneath a predetermined value, or when the pressure within the intermediate purge passage exceeds the pressure within the intake passage. Thus, the "predetermined pre-drive" time may be terminated at an appropriate point in time.

In the above-discussed embodiments, the second opening degree may correspond to a maximum opening degree of the purge valve and the second duty ratio may correspond to a maximum duty ratio. With this setting of the second opening degree and the second duty ratio, it may be possible to further shorten the time lag. Also, the second opening degree and/or the second duty ratio may be configured to further shorten time lags and/or delays between, for example, opening of the check valve and opening of the purge valve to regulate pressure within the intake passage and/or the intermediate purge passage.

Also, in each of the above embodiments, a value of the second opening degree or the second duty ratio may change according to the difference between the pressure within the intake passage and the pressure within the intermediate purge passage. Accordingly, the second opening degree or the second duty ratio may be suitably set according to this pressure difference.

In another embodiment, the controller may determine whether a predetermined execution condition for the purge control has been met, and the controller may control the purge valve to open with the first opening degree or the first duty ratio if the purge control is initiated according to a determination that predetermined condition has been met. The controller may begin counting the predetermined arrival time after elapse of a predetermined additional time from initiation of the purge control.

Thus, during a potential time delay between opening the check valve after opening of the purge valve, the controller may not start counting the predetermined arrival time but may rather start counting the predetermined arrival time after elapse of the predetermined additional time. Thus, although the time delay may not be shortened, fuel injection quantity may be reduced at an appropriate time via regulation of the predetermined arrival time and/or the predetermined additional time, as described above, to minimize a fluctuation of the air-fuel ratio during the purge control.

Further, the controller may calculate the predetermined additional time based on a difference between a pressure within the intake passage and a pressure within the intermediate purge passage at a time when the predetermined execution condition has been met.

The controller may start counting the predetermined arrival time prior to the elapse of the predetermined additional time, when a difference between a pressure within the intake passage and a pressure within the intermediate purge passage falls beneath a predetermine value during counting of the predetermined additional time, or when the pressure within the intermediate purge passage exceeds the pressure within the intake passage during counting of the predetermined additional time. As discussed, the time when the predetermined arrival time elapses may be determined as desired.

In the above-discussed embodiments, the fuel vapor supply system may further include a pressure detection device that detects pressure within the intake passage. Further, the controller may make an estimation of the pressure within the intermediate purge passage. Should the purge valve be fully closed, the controller may estimate the pressure within the intermediate purge passage to be equal to a smallest value of detected values of the pressure within the intake passage. In contrast, should the purge valve not be fully closed, i.e. where the purge valve is at least partially open, the controller may estimate the pressure within the intermediate purge passage to be equal to the pressure within the intake passage detected at a time when a predetermined variation transition time has elapsed after starting the purge control.

As discussed above, the pressure within the intermediate purge passage may be estimated without using a pressure detection device configured to detect the pressure within the intermediate purge passage.

Further, the controller may change a length of a "predetermined variation transition" time based on a difference between the pressure within the intake passage detected by the pressure detection device and the pressure within the intermediate purge passage estimated when the purge valve is fully closed. Accordingly, the pressure within the intermediate purge passage may be estimated at an appropriate time after elapse of the predetermined variation transition time during which the intermediate purge passage pressure may be, for example, unstable.

Should the purge valve not be fully closed, the controller may estimate the pressure within the intermediate purge passage to be equal to the atmospheric pressure. This estimation may take place as long as the pressure within the intake passage is higher than the atmospheric pressure at the time when the predetermined variation transition time has elapsed after initiating the purge control.

Accordingly, the pressure within the intermediate purge passage may be appropriately estimated even where the check valve is fully closed as a result of positive pressure within the intake passage.

DETAILED DESCRIPTION OF THE PREFERRED EMBODIMENTS

Figure 1:
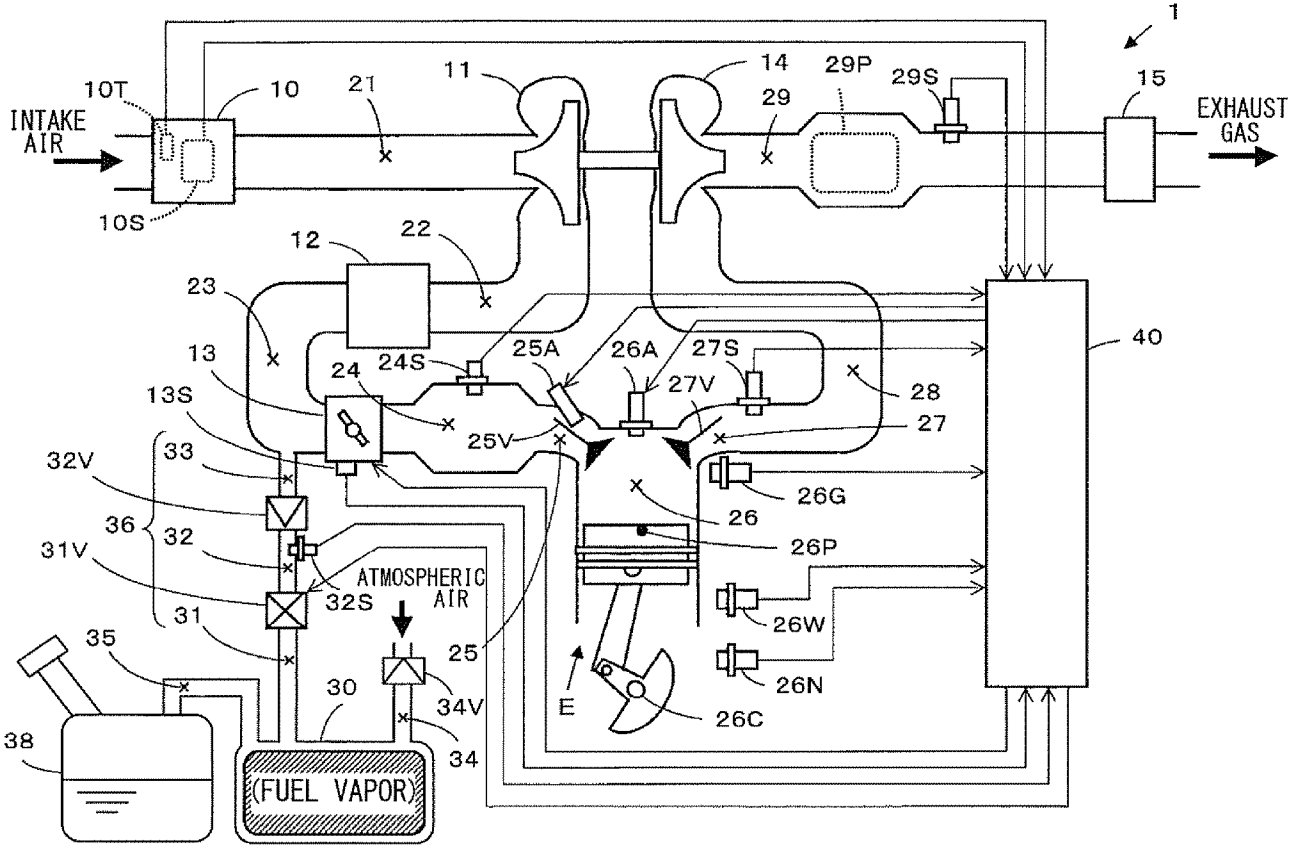
FIG. 1 is a schematic view illustrating an engine control system incorporating a fuel vapor supply system and showing the construction of the fuel vapor supply system, which is in common with the comparative example and first to fifth embodiments.

Referring generally to FIG. 1, an engine control system 1 is shown. The engine control system 1 may be used in a vehicle, such as an automobile, and may include an internal combustion engine E (hereinafter simply referred to as "engine E") configured to provide power to and/or propel the vehicle as desired. In an embodiment, the internal combustion engine E may be a conventional, gasoline-powered engine. The engine control system 1 may include a forced and/or artificial induction means such as a supercharger, compressor, turbocharger and/or the like which may be associated with the engine E to enhance engine E output and/or performance.

As shown in FIG. 1, the engine control system 1 may have a controller 40, an air cleaner 10, a first intake passage 21, a compressor 11, a second intake passage 22, an intercooler 12, a third intake passage 23, a throttle device 13, a fourth intake passage (i.e., a surge tank) 24, an intake manifold 25, a combustion chamber 26, an exhaust manifold 27, a first exhaust passage 28, a turbine 14, a second exhaust passage 29, a catalyst 29P and a muffler 15 arranged in, for example, in a series in order in the direction from an intake side of air (i.e. denoted by "INTAKE AIR" in FIG. 1) to an exhaust side of exhaust gas (i.e. denoted by "EXHAUST GAS" in FIG. 1). The controller 40 may control operations of various components of the engine control system 1. In an embodiment, a combination of the compressor 11 and the turbine 14 may serve as a forced and/or artificial induction device configured to regulate air pressure, i.e., compress air, to, for example, enhance engine power output and/or efficiency. Due to the incorporation of the forced and/or artificial induction device as generally described herein with the engine control system 1, the pressure of the intake air within the first to fourth intake passages 21 to 24 and the intake manifold 25 may have a "negative" value, i.e., a pressure lower than the atmospheric pressure, in some instances and may have a "positive" value (i.e., a pressure higher than the atmospheric pressure) in other instances. Further, in an embodiment, the controller 40 may be an engine control unit (ECU) that may include a CPU. The CPU may include a microprocessor and memory, such as a RAM and a ROM, adapted to store control programs for executing various controls, such as a purge control, that will be explained in further detail later.

Referring generally to FIG. 1, a canister 30 may be connected to a fuel tank 38 via a passage 35. The canister 30 may contain adsorbent configured to adsorb fuel vapor. Accordingly, fuel vapor generated in the fuel tank 38, may then be adsorbed by the canister 30, i.e., after first flowing through the passage 35. Also, an air introduction passage 34 and a purge passage 36 may be connected to the canister 30 where one end of the purge passage 36 positioned opposite to the canister 30 may be connected to the third intake passage 23. Thus, the purge passage 36 may connect the canister 30 and the third intake passage 23. A backflow preventing valve 34V may be disposed in and/or on, i.e. mounted within, the air introduction passage 34 to permit and/or regulate flow of the atmospheric air into the canister 30 and may also prevent flow of fuel vapor from within the canister 30 to the atmosphere. A purge valve 31V may be disposed in and/or on, i.e. mounted within, the purge passage 36 at a position on a side of the canister 30. Likewise, a check valve 32V may be disposed in and/or on, i.e. mounted within, the purge passage 36 at a position on a side of the third intake passage 23 where purge passage 36 may include a canister-side purge passage 31 that extends between the canister 30 and the purge valve 31V, and an intermediate purge passage 32 that extends between the purge valve 31V and the check valve 32V, and an intake-side purge passage 33 that extends between the check valve 32V and the third intake passage 23. A pressure detection device 32S, such as a pressure sensor, may be attached to and/or coupled with the intermediate purge passage 32 to detect the pressure, i.e. of fuel vapor and/or other substances etc., within the intermediate purge passage 32. Moreover, the pressure detection device 32S may output a detection signal to the controller 40, however, and as will be explained in further detail later, the pressure detection device 32S may be omitted in some instances.

The purge valve 31V described above may be an electromagnetic type valve and may function to open and/or close the purge passage 36 to regulate the flow rate of fuel vapor (i.e., where fuel vapor generally denotes a gas mixture of both fuel vapor and ambient/atmospheric air) flowing from the canister 30 to the third intake passage 23. The purge valve 31V may be electrically connected to and/or coupled with the controller 40, such that the purge valve 31V may function to open and/or close the purge passage 36 as controlled by the controller 40. In an embodiment, the purge valve 31V may be periodically operated according to a duty ratio signal that may represent a duty ratio of a valve opening time to a predetermined period. In detail, the purge valve 31V may be fully opened in the valve opening time and may be fully closed in some other time outside the predetermined period. Additionally, the purge valve 31V adjusts a degree of opening according to a rotation angle signal or a slide distance signal to, for example, partially open and/or partially close.

The check valve 32V may be disposed in and/or on, i.e. mounted within, the purge passage 36 at a position between the purge valve 31V and the third intake passage 23. In detail, the check valve 32V may be configured to permit flow of a fluid (i.e., fuel vapor containing gas) from the canister 30 to the third intake passage 23 and may also be configured to block and/or otherwise prevent flow of a fluid (i.e., intake and/or atmospheric air) from the third intake passage 23 to the canister 30. Further, the check valve 32V may be closed should the pressure within the third intake passage 23 (hereinafter referred to as the "intake passage pressure") be equal to or higher than the pressure within the intermediate purge passage 32 (hereinafter referred to as the "intermediate purge passage pressure"). In other words, the check valve 32V may be closed if the "intake passage pressure P(23)" is "intermediate purge passage pressure P(32)". In contrast, the check valve 32V may be opened if the intake passage pressure is lower than the intermediate purge passage pressure, i.e., if the "intake passage pressure" is <"intermediate purge passage pressure."

As shown in FIG. 1, the air cleaner 10 may filter, trap and/or remove potentially harmful particles, such as dust, from the intake air. A flow rate detection device 10S, such as an air-flow sensor, may be configured to detect the flow rate of the intake air, and a temperature detection device 10T, such as a temperature sensor, may be configured to detect the temperature of the intake air and may be attached to, coupled with and/or otherwise disposed in and/or on the air cleaner 10. Also, the flow rate detection device 10S and the temperature detection device 10T may output a detection signal to the controller 40.

Also, the turbine 14, upon, for example, rotation, may generate a rotational drive force that is transmitted to the compressor 11 to rotatably drive the compressor 11 to compress the intake air drawn from within the first intake passage 21 as desired to enhance, for example, overall engine output and/or efficiency. The intake air, compressed as described above, may then be fed to the second intake passage 22 as, for example, compressed and/or "supercharged" air. As may be desirable to ensure uniform operational efficiency of the engine E, the intercooler 12 may receive and cool the intake air supercharged by the compressor 11. Moreover, pressure of the fuel vapor, air and/or any mixture of the same may increase and thus exceed atmospheric pressure due to compression by the compressor 11 as described above, and/or in the case of a backfire, i.e. where fuel vapor pressure builds up and/or accumulates due to some unexpected blockage within the engine control system 1.

The throttle device 13 may include a throttle valve that may adjust an opening area of the third intake passage 23 and/or the fourth intake passage 24 by, for example, altering a rotational angle of the throttle device 13. In detail, the rotational angle of the throttle valve may be controlled by the controller 40 based on a detection signal of a movement detection device (not shown in the FIGS.) that detects a movement distance of an acceleration pedal that may be, for example, operated by a user of the vehicle and/or according to various parameters indicative of various operational conditions associated with the internal combustion engine. Further, a rotational angle detection device 13S, such as a throttle angle sensor, may detect the rotational angle of the throttle valve and may accordingly output a detection signal to the controller 40.

In an embodiment, the fourth intake passage 24 may be a surge tank where a pressure detection device 24S, such as a pressure sensor, may be attached to, coupled with, and/or disposed in and/or on the fourth intake passage 24 to detect the pressure within the fourth intake passage 24 (i.e., the pressure within the third and fourth intake passages 23 and 24 as well as the intake manifold 25). Further, the pressure detection device 24S may output information regarding pressure detected as generally described above as a detection signal to the controller 40.

As shown in FIG. 1, the engine E may include an injector 25A mounted to the intake manifold 25 where the injector 25A may be configured to inject fuel into the engine E as needed for fuel consumption and/or combustion as associated with operation of the engine E. Although only one injector 25A is shown in FIG. 1 for representative purposes, a plurality of injectors 25A may be mounted to the intake manifold 25, as needed, to supply fuel to one or more engine cylinders (not shown in the FIGS.), depending on, for example, the configuration and/or layout of the engine E. Further, liquid fuel may be delivered from the fuel tank 38 to the injector 25A, which may then spray and/or inject the liquid fuel to the engine cylinders as described above. Moreover, a valve opening time of the injector 25A may be controlled based on a control signal output from the controller 40. In an embodiment, the injector 25A may also atomize the liquid fuel and inject the atomized liquid fuel into the combustion chamber 26 of the engine cylinder during the valve opening time. Also, the engine E may further include an intake valve 25V, an exhaust valve 27V and a piston 26P as shown in FIG. 1.

An ignition plug 26A may be mounted in, attached to and/or disposed on and/or in the combustion chamber 26 of the engine E. Further, and in accordance to a control signal outputted from the controller 40, the ignition plug 26A may generate sparks in the combustion chamber 26 to combust and/or explode the compressed mixture of air and fuel supplied to the combustion chamber 26.

A crank rotation detection device 26N, such as a crank rotation sensor, may detect rotation of a crankshaft 26C of the engine E. Further, a water temperature detection device 26W, such as a temperature sensor, may detect the temperature of coolant that cools the engine E. A cylinder position detection device 26G, such as a rotation sensor, may detect the rotational position of a camshaft (not shown in the FIGS.). Detection signals of the crank rotation detection device 26N, the water temperature detection device 26W and the cylinder position detection device 26G may be output to the controller 40.

An air-fuel ratio detection device 27S, such as an A/F sensor, may be attached to the exhaust manifold 27 to detect the air-fuel ratio of the air-fuel mixture, for example, by measuring the concentration of oxygen contained in the exhaust gas after combustion and explosion of the air-fuel mixture within the combustion chamber 26. Also, a detection signal of the air-fuel ratio detection device 27S may be output to the controller 40.

As initially introduced earlier, the turbine 14 may rotate upon contact with the exhaust gas flowing from the first exhaust passage 28 where such rotation of the turbine 14 may be transferred to the compressor 11. Exhaust gas responsible for rotating the turbine 14 may be subsequently discharged to the second exhaust passage 29.

The catalyst 29P may be, for example, a three-way catalyst and may be designed to efficiently purify harmful substances when the air-fuel ratio detected by the air-fuel ratio detection device 27S falls within a predetermined range. Such a predetermined range as described here may be calculated and/or determined by reference to a theoretical air-fuel ratio, i.e., ($\lambda$=1.0).

An oxygen detection device 29S, such as an $O_2$ sensor, may be attached to and/or coupled with the second exhaust passage 29 at a position on a downstream side of the catalyst 29P. In detail, the oxygen detection device 29S may detect whether oxygen is contained in the exhaust gas flowing across the catalyst 29P to exit the engine control system 1 via the muffler 15, for example. Also, the oxygen detection device, described above, may detect oxygen levels in the exhaust gas to output a detection signal to the controller 40, which may in turn adjust other parameters within the engine control system 1 to ensure, for example, uniform and consistent engine E operation.

Further, as shown in FIG. 1, the fuel vapor supply system may include the canister 30, the purge passage 36, which may be in fluid communication therewith, the purge valve 31V, the check valve 32V and the controller 40.

Figure 2:
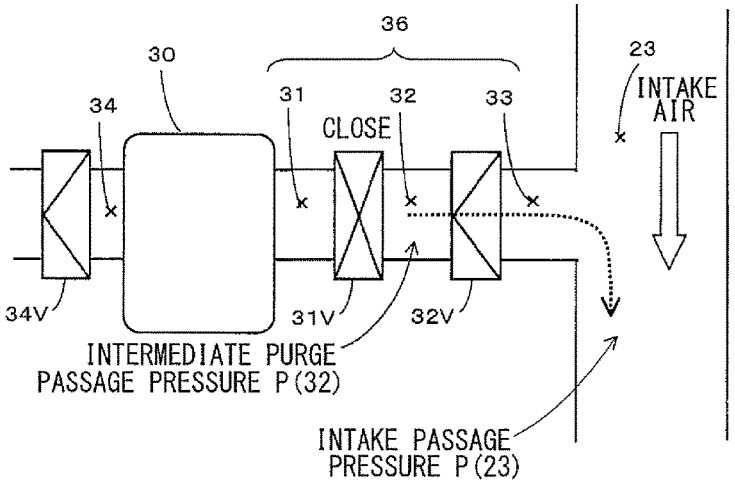
FIG. 2 is a schematic view illustrating a condition for opening a check valve when a purge valve is closed, the check valve and the purge valve being components of the fuel vapor supply system.
Figure 3:
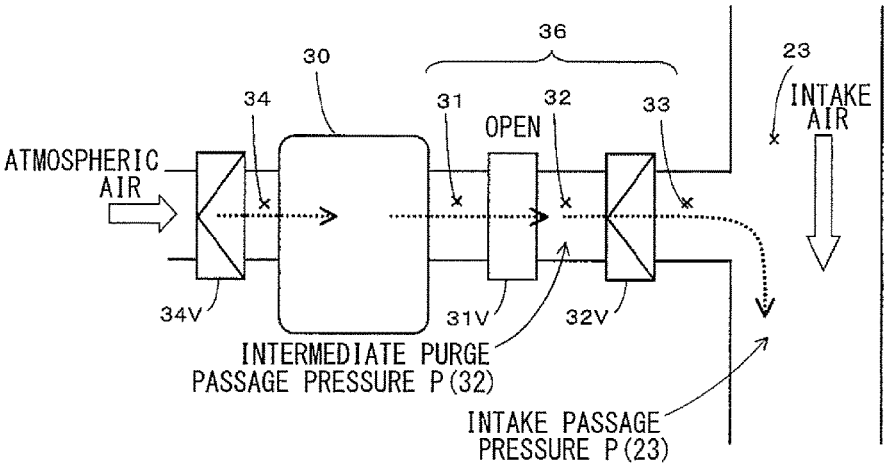
FIG. 3 is a schematic view illustrating a condition for opening the check valve when the purge valve is open.

Referring now to FIGS. 2 and 3, the check valve 32V may be mounted in, disposed in and/or on the purge passage 36 in addition to the purge valve 31V that may be controlled by the controller 40. In an embodiment, the check valve 32V may automatically open and close and thus may not be necessarily be directly controlled by the controller 40. Further, the conditions and/or predetermined parameters for opening and closing the check valve 32V may depend on the opening and closing condition of the purge valve 31V. Thus, the conditions for opening the check valve 32V will be described in connection with the state where the purge valve 31V is fully closed (see FIG. 2) and the state where the purge valve 31V is open (i.e. not fully closed) (see FIG. 3).

When the purge valve 31V is fully closed as shown in FIG. 2, the check valve 32V may be opened if the pressure within the third intake passage 23 (hereinafter referred to as the "intake passage pressure P(23)") is lower than the pressure within the intermediate purge passage 32 (hereinafter referred to as the "intermediate purge passage pressure P(32)"). Thus, the check valve 32V may be opened if the intake passage pressure P(23) is <intermediate purge passage pressure P(32) (i.e., if the intake passage pressure P(23) is less than the intermediate purge passage pressure P(32)). Alternatively, the check valve 32V may be closed if the intake passage pressure P(23) is intermediate purge passage pressure P(32) (i.e., if the intake passage pressure P(23) is greater than or equal to the intermediate purge passage pressure P(32)). Thus, should the pressure within the third intake passage 23 fluctuate during the time when the purge valve 31V is fully closed, the lowest or smallest pressure during the fluctuation may be retained within the intermediate purge passage 32. As a result, the intermediate purge passage 32 may be sealed while maintaining a "negative," i.e., less than atmospheric, pressure therein.

When the purge valve 31V is at least partially open (i.e., not fully closed) as shown in FIG. 3, the check valve 32V may be opened if the intake passage pressure P(23) is lower than the atmospheric pressure, i.e., if the intake passage pressure P(23) is a "negative" pressure. Thus, the check valve 32V may be opened if the "intake passage pressure P(23) is <atmospheric pressure" is when the purge valve 31V is already open. When the check valve 32V is opened on this condition, i.e., when the purge valve 31V is already open as described here, atmospheric air may be introduced into the canister 30 via the backflow preventing valve 34V and the air introduction passage 34. Therefore, fuel vapor may be desorbed from inside the canister 30 by the flowing atmospheric air and then carried by the atmospheric air, which may behave and/or function as a fuel vapor containing gas. The fuel vapor containing gas may then be drawn into, i.e., via, for example, a suction effect produced by variance in pressure as generally described above, the third intake passage 23 via the canister-side purge passage 31, the purge valve 31V, the intermediate purge passage 32, the check valve 32V and the intake-side purge passage 33. Moreover, the check valve 32V may be closed if the intake passage pressure P(23) is equal to or higher than the atmospheric pressure, i.e., if the intake passage pressure P(23) is a positive pressure, when the purge valve 31V is open.

Figure 5:
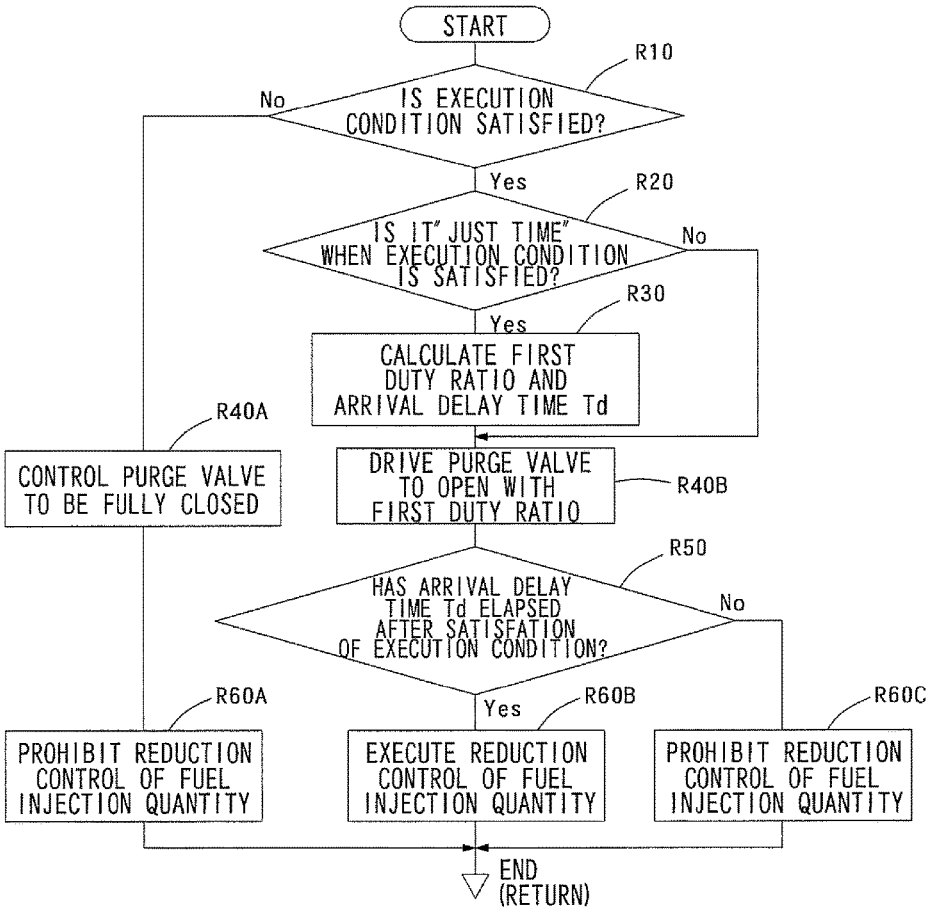
FIG. 5 is a flowchart illustrating a purge control according to a comparative example.

Referring now generally to FIG. 5, a flowchart depicting an embodiment of a purge control process performed by the controller 40 is shown. In detail, the controller 40 may periodically initiate the process shown by the flowchart at predetermined time intervals, such as 10 milliseconds ("ms"), or at a point in time that corresponds to a predetermined crank angle, such as a crank angle of 180 degrees. The process of the flowchart may be performed according to the program stored in a memory (not shown in the FIGS.) of the controller 40.

At Step R10 of the flowchart, the controller 40 may determine if a defined execution condition for the purge control has been satisfied or established. For example, should the execution condition be satisfied (i.e., "Yes") at Step R10, the process may proceed to Step R20. In contrast, should the execution condition fail to be satisfied (i.e., "No") at Step R10, the may proceed to Step R40A. The execution condition may be, for example, whether or not a predetermined amount of fuel vapor has been adsorbed by the adsorbent of the canister (e.g., canister 30). Step R20 may determine if it is just the time when the execution condition has been satisfied. If the determination at Step R20 is "YES", the process may proceed to Step R30. In contrast, should the determination at Step R20 is "NO", the process may proceed to Step R40B.

Step R40A may control the purge valve 31V to fully close the purge valve 31V. Subsequently, the process may proceed to Step R60A where the controller 40 may prohibit a reduction control of the fuel injection quantity of the injector 25A. The process may be completed and returned to Step R10.

As shown in FIG. 5, step R30 may calculate a first duty ratio and an arrival delay time Td. The first duty ratio may correspond to a first opening degree that may represent, for example, a degree of opening of the purge valve 31V during the purge control. The arrival delay time Td may be calculated based on, for example, the number of rotations of the crankshaft 26C detected by the crank rotation detection device 26N, the flow rate of the intake air detected by the flow rate detection device 10S, the degree of opening of the purge valve 31V, the pressure within the third intake passage 23 detected by the pressure detection device 24S (see FIG. 1, etc.).

Figure 4:
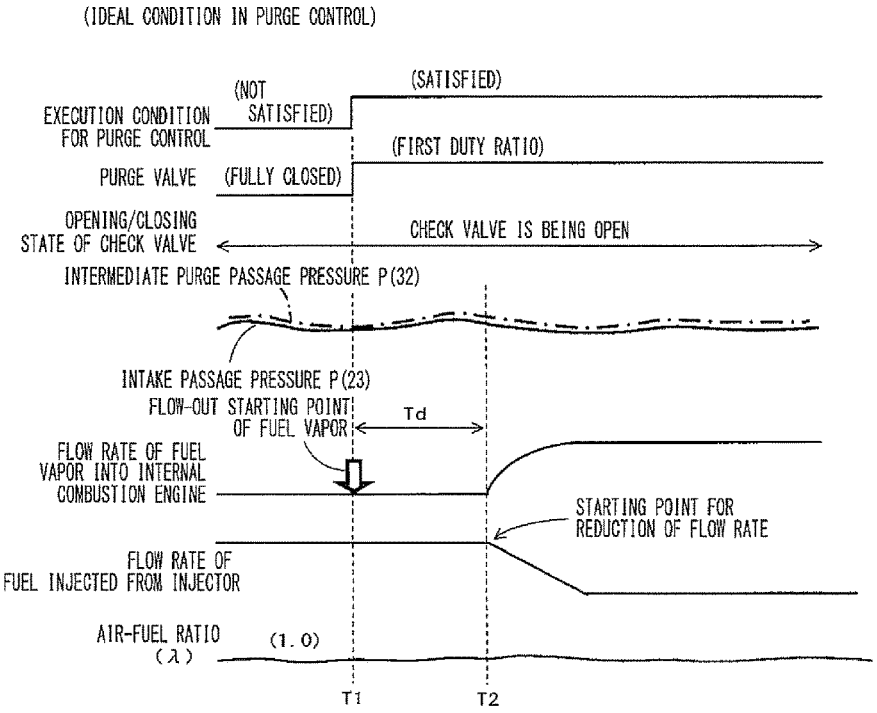
FIG. 4 is a time chart illustrating an ideal purge control, in which the check valve is opened if an intermediate purge passage pressure is equal to or higher than an intake passage pressure at a time when a purge control is started.

Step R40B may drive the purge valve 31V to open with the first duty ratio (or the first opening degree). The process may then proceed to Step R50. A time chart shown in FIG. 4 illustrates ideal operations of various components and parameters. In this time chart, the check valve 32V may open when the purge valve 31V is driven to open with the first duty ratio at Time T1. Therefore, the flow of fuel vapor from the canister 30 may begin at Time T1 if the "intake passage pressure P(23) is intermediate purge passage pressure P(32)." Nevertheless, on account of a distance separating the intermediate purge passage 32 from the engine E, fuel vapor may take an arrival delay time Td to arrive at the engine E after departing from, i.e. flowing from, the canister 30. For this reason, the flow rate of the fuel vapor into the engine E may increase at Time T2 after elapse of the arrival delay time Td as shown in FIG. 4.

Step R50 may determine whether the arrival delay time Td has elapsed after satisfaction of the execution condition of the purge control. Should the arrival delay time Td have elapsed (i.e., "Yes") at Step R50, the process may proceed to Step R60B. Should the arrival delay time Td not elapse (i.e., "No") at Step 50, the process may proceed to Step R60C.

Step R60B may perform a reduction control to reduce the quantity of fuel injected by the injector 25A, and the process may then conclude to return to Step R10. In the time chart shown in FIG. 4, the fuel injection quantity of the injector 25A may be proportionately reduced to compensate for an increase of the flow of the fuel into the engine E after Time T2 (i.e., after elapse of the arrival delay time Td from Time T1). Therefore, unwanted fluctuation in the air-fuel ratio may be inhibited to maintain the theoretical air-fuel ratio (i.e., $\lambda=1.0$) as desired.

Referring now to FIG. 5, Step R60C may prohibit the reduction control, as described above, to allow the process to conclude and return directly to Step R10.

A "comparative example," i.e. in comparison to that described above, will be described with reference to FIG. 6 where the intermediate purge passage pressure P(32) is <intake passage pressure P(23) when the purge operation is initiated.

The time chart shown in FIG. 4 is provided with the assumption that the check valve 32V is already open upon initiating the purge control. However, the check valve 32V may remain closed if the intake passage pressure P(23) is >(i.e., greater than) intermediate purge passage pressure P(32) when the purge control is initiated. In such a condition, the intermediate purge passage 32 may be closed to maintain a negative pressure therein. As a result, the check valve 32V may still be closed when the purge valve 31V is driven to open with the first duty ratio (i.e., the first opening degree) at Step R40B of the flowchart shown in FIG. 5 (see Time T1 in FIG. 6). At Time T1, the air introduced into the canister 30 may begin to flow into the intermediate purge passage 32 from a side of the purge valve 31V (i.e., as shown in FIG. 1), and the intermediate purge passage pressure P(32) may progressively increase after time T1 (see Time T1 to time T3 in FIG. 6).

In the "comparative example," i.e. in comparison to that described above, shown in FIG. 6, the check valve 32V may remain closed at Time T2 when the arrival delay time Td has elapsed after initiating the driving of the purge valve 31V for opening with the first duty ratio. Therefore, should the fuel injection quantity of the injector 26A be reduced at Time T2, a relative shortage of fuel may occur to cause an increase in the air-fuel ratio (i.e., to shift the air-fuel ratio to the lean side or the excessive air side) because fuel vapor may not arrive at the engine E at Time T2. Such a condition, i.e. a "lean" and/or "excessive air" air-fuel ratio as described above, may not match the theoretical air-fuel ratio and thus not be desirable for engine E operation.

In the "comparative example," the check valve 32V may open at Time T3 when the intermediate purge passage pressure P(32) is ≥intake passage pressure P(23). Therefore, the flow rate of the fuel vapor into the engine E may begin to increase at Time T4 when the arrival delay time Td has elapsed after Time T3. The period from Time T1 to Time T3 may be a time delay until the check valve 32V is opened after the purge valve 31V is opened.

A first, second, third, fourth and fifth embodiments will now be described in further detail. These embodiments relate to fuel vapor supply systems, where each embodiment of the embodiments may be configured to perform a purge control, where the above-described time lag may either be taken into account or minimized. Also, the purge control of each of the embodiments may be performed according to the program stored in a memory (not shown in the FIGS.) of the controller 40.

The purge control performed by the controller 40 according to the first embodiment will now be described with reference to a time chart shown in FIG. 7 and a flowchart shown in FIG. 8. Similar to the comparative example discussed above, the controller 40 may periodically start the process of the flowchart at predetermined time intervals, such as intervals of 10 ms, or at time points each corresponding to a predetermined crank angle, such as a crank angle of 180 degrees.

At Step S10 of the flowchart, the controller 40 may determine whether an execution condition for the purge control is satisfied. Should the execution condition be satisfied (i.e., "Yes") at Step S10, the process may proceed to Step S20. Should the execution condition not be satisfied (i.e., "No") at Step S10, the process may proceed to Step S50A.

Step S50A may control the purge valve 31V such that the purge valve 31V is fully closed. Subsequently, the process may proceed to Step S70A where the controller 40 may prohibit a reduction control of the fuel injection quantity of the injector 25A, and the process may then conclude to return to Step S10.

Step S20 determines whether the execution condition of the purge control is satisfied at a "just time," i.e., the time when a change from unsatisfaction to satisfaction occurs with respect to the execution condition. Should the determination at Step S20 be "Yes", the process may proceed to Step S30. Otherwise, the process may proceed to Step S40.

Step S30 may calculate a first duty ratio, a second duty ratio, a predetermined time Tp and an arrival delay time Td. The first duty ratio may correspond to a first opening degree, i.e., a degree of opening of the purge valve 31V normally applied during the purge control. The second duty ratio may correspond to a second opening degree that is also a degree of opening of the purge valve 31V, but may be temporarily applied when or after initiating the purge control. The second duty ratio (second opening degree) may be larger than the first duty ratio (first opening degree). The predetermined time Tp may be a time delay, i.e. the amount of time necessary for the intermediate purge passage pressure P(32) to exceed the intake passage pressure P(23). The predetermined time Tp may be calculated based on the intake passage pressure P(23), the intermediate purge passage pressure P(32), and the degree of opening of the purge valve 31V, etc. As generally described for the comparative example discussed above, the arrival delay time Td may be calculated based on, for example, the number of rotations of the crankshaft 26C detected by the crank rotation detection device 26N, the flow rate of the intake air detected by the flow rate detection device 10S, the degree of opening of the purge valve 31V, and the pressure within the third intake passage 23 detected by the pressure detection device 24S (see FIG. 1, etc.).

Step S40 may determine whether the predetermined time Tp has elapsed after satisfaction of the execution condition of the purge control. Should the determination at Step S40 be "Yes", the process may proceed to Step S50B. Should the determination be "No", the process may proceed to Step S50C.

Figure 6:
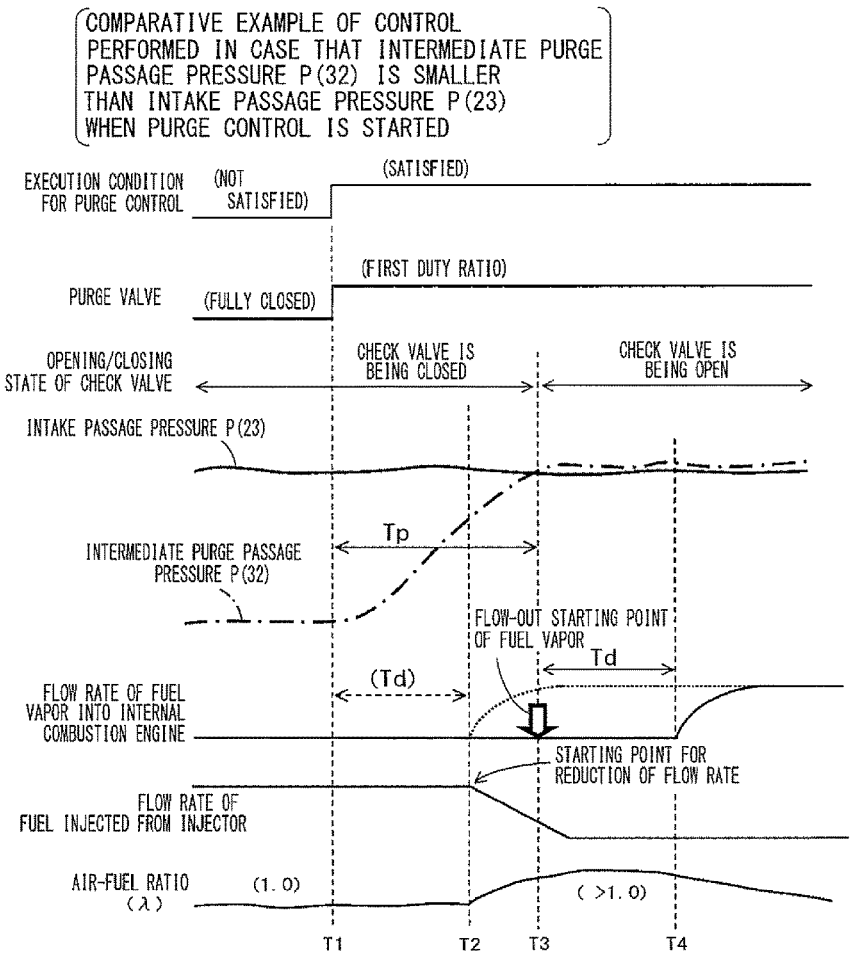
FIG. 6 is a time chart illustrating the purge control according to the comparative example and showing a time lag until the check valve is opened after starting the purge operation, the check valve being opened by a difference between the intermediate purge passage pressure and the intake passage pressure larger than the intermediate purge passage pressure at the time of starting the purge operation.
Figure 7:
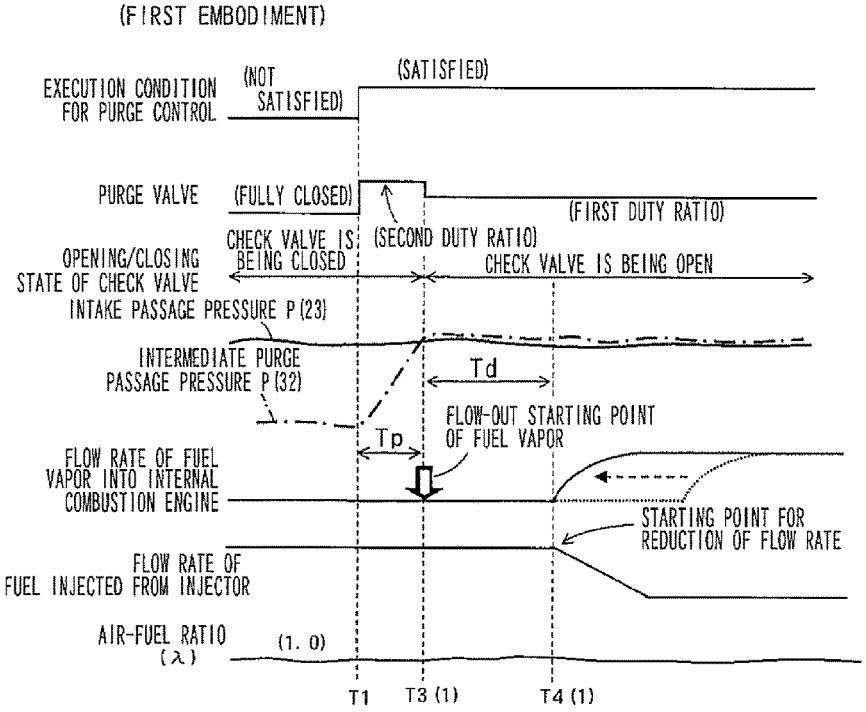
FIG. 7 is a time chart illustrating a purge control performed by a fuel vapor supply system according to a first embodiment.

Step S50C may drive the purge valve 31V to open with the second duty ratio (or the second opening degree larger than the first opening degree), so that the time delay (the time between Time T1 and Time T3(1) in FIG. 7) may be reduced. After the reduction of the time delay as described above, the process may proceed to Step S70C. Accordingly, by driving the purge valve 31V to open with the second duty ratio larger than the first duty ratio, the time delay between Time T1 and Time T3(1), as shown in FIG. 7, may be made shorter than the time lag between Time T1 and Time T3 shown in FIG. 6 of the comparative example. In the time chart shown in FIG. 7, at time T3(1) after the predetermined time Td has elapsed, should the intermediate purge passage pressure P(32) be ≥intake passage pressure P(23), the check valve 32V may open from a closed state.

Step S70C may prohibit the reduction control of the fuel injection quantity, i.e., the reduction of fuel injected by the injector 25A, such that the process may conclude and return to Step S10.

At Step S50B that may be executed after Time T3(1) in FIG. 7, the controller 40 may drive the purge valve 31V to open with the first duty ratio (or the first opening degree). The process may then proceed to Step S60.

Step S60 may determine whether the arrival delay time Td has elapsed after the time of the end of the predetermined time Tp (i.e., after time T3(1)). Should the determination at Step S60 be "Yes", the process may proceed to Step S70B. Should the determination at Step S60 be "No", the process may then proceed to Step S70C.

Step S70B may perform a reduction control of the fuel injection quantity of the injector 25A, and the process may then conclude to return to Step S10. In the time chart shown in FIG. 7, the fuel injection quantity of the injector 25A may be proportionately reduced to compensate for an increase of the flow of fuel and/or fuel vapor into the engine E after Time T4(1) (i.e., after elapse of the time delay (predetermined time Tp) and the arrival delay time Td from satisfaction of the execution condition of the purge control. As a result, fluctuation in the air-fuel ratio may be appropriately inhibited to maintain a theoretical air-fuel ratio (i.e., $\lambda=1.0$) or a ratio near $\lambda=1.0$.

As described above, in the first embodiment, the purge valve 31V may be driven to open with the second duty ratio (or the second opening degree) during the time between Time T1 and Time T3(1), i.e., the time until opening of the purge valve 31V from starting the purge operation. However, the purge valve 31V may be driven to open with the second duty ratio during only a part of the time between Time T1 and Time T3(1).

The second duty ratio (or the second opening degree) may be set to correspond to a maximum opening degree (i.e., a full opening degree) of the purge valve 31V. Alternatively, the second duty ratio (or the second opening degree) may be calculated and/or adjusted based on a difference between the intake passage pressure P(23) and the intermediate purge passage pressure P(32).

Further, although the determination is made whether the predetermined time Tp has elapsed after satisfaction of the execution condition of the purge control at Step S40, this determination may be replaced with an alternative determination whether the intermediate purge passage pressure P(32) is higher than the intake passage pressure P(23). In such an instance, should the intermediate purge passage pressure P(32) be higher than the intake passage pressure P(23) at Step S40, the process may proceed to Step S50B to change from the second duty ratio to the first duty ratio. Alternatively, the determination at Step S40 may be replaced with a determination whether a difference between the intermediate purge passage pressure P(32) and the intake passage pressure P(23) is smaller than a predetermined value. In such an instance, if the intermediate purge passage pressure P(32) is higher than the intake passage pressure P(23) at Step S40, the process may proceed to Step S50B to change from the second duty ratio to the first duty ratio. In this case, the arrival delay time Td may be counted starting from the time when the second duty ratio is changed to the first duty ratio.

Figure 8:
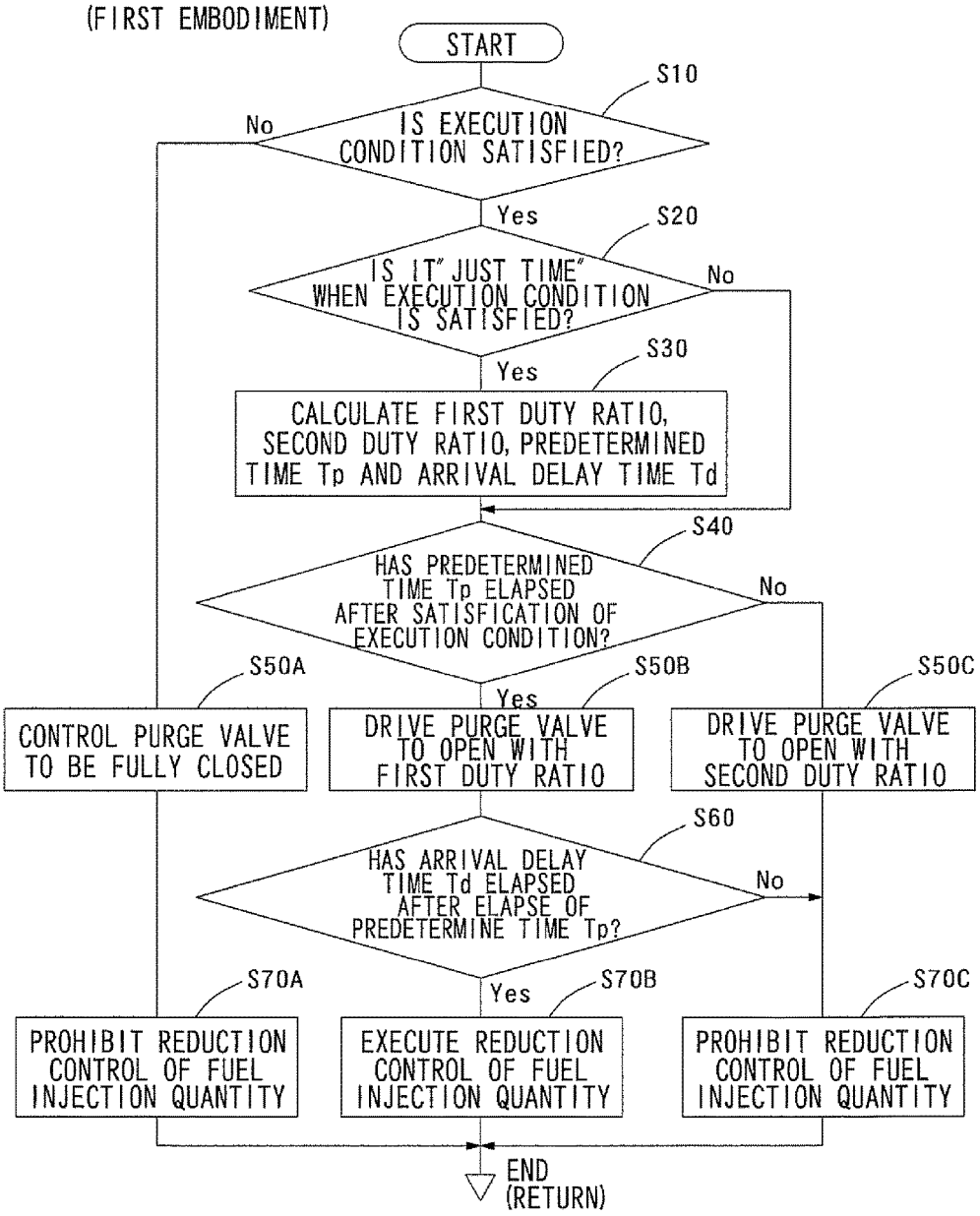
FIG. 8 is a flowchart illustrating a control process of the purge control performed by the fuel vapor supply system according to the first embodiment.

According to the first embodiment shown in FIGS. 7 and 8 described above, fluctuation in the air-fuel ratio may be inhibited and/or minimized during the execution of the reduction control of the fuel injection quantity of the injector 25A, when compared to the comparative example shown in FIGS. 5 and 6. As a result, the purge control may be performed to produce desirable results. In addition, the time delay until the check valve 32V is opened from starting the purge control (i.e., the time between Time T1 and time T3(1) in FIG. 7) may be shortened in comparison with the time delay in the comparative example (i.e., the time between Time T1 and Time T3 in FIG. 6).

In the first embodiment, should the intermediate purge passage pressure P(32) be equal to or higher than the intake passage pressure P(23) at the time when the purge control is initiated, the predetermined time Tp may be set to be zero because the check valve 32V is already opened. Therefore, the purge valve 31V may not be driven with the second duty ratio during the purge control.

Figure 9:
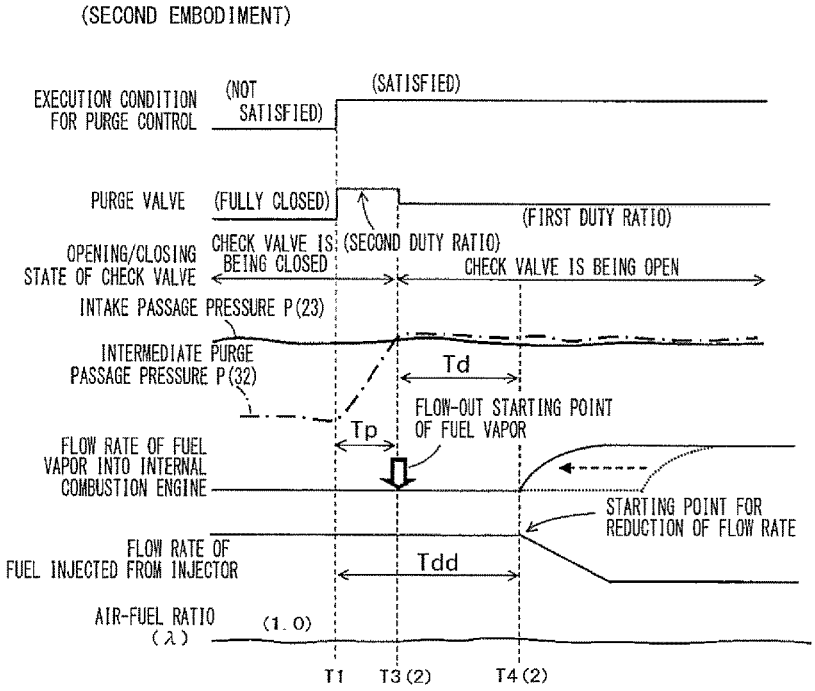
FIG. 9 is a time chart illustrating a purge control performed by a fuel vapor supply system according to a second embodiment.

The purge control performed by the controller 40 according to the second embodiment will now be described with reference to a time chart shown in FIG. 9 and a flowchart shown in FIG. 10. In the first embodiment shown in FIGS. 7 and 8, the reduction of the fuel injection quantity of the injector 25A starts at Time T4(1) with reference to Time T3(1). The second embodiment may differ from the first embodiment in that the reduction of the fuel injection quantity of the injector 25A begins at Time T4(2) with reference to Time T1. In all other respects, the second embodiment may be identical to the first embodiment.

Figure 10:
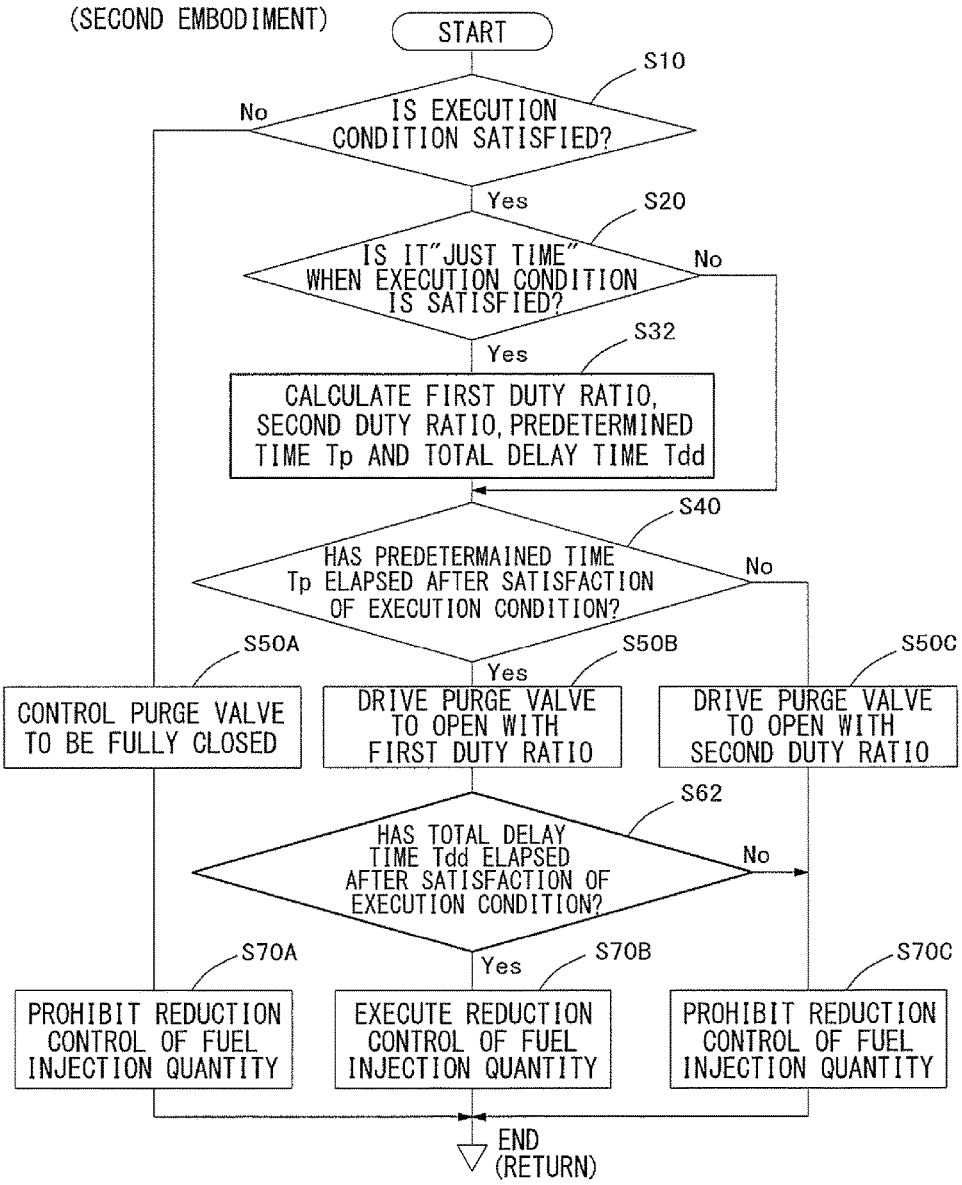
FIG. 10 is a flowchart illustrating a control process of the purge control performed by the fuel vapor supply system according to the second embodiment.

The flowchart shown in FIG. 10 differs from the flowchart shown in FIG. 8 in that Step S30 is replaced with Step S32 and that Step S60 is replaced with Step S62.

Step S32 may calculate the first duty ratio (i.e., a normally applied duty ratio), the second duty ratio (i.e., a temporarily applied duty ratio), the predetermined time Tp and a total delay time Tdd. The process may then proceed to Step S40. The total delay time Tdd is the sum of the predetermined time Tp and the arrival delay time Td. The arrival delay time Td may be calculated in the same manner as described earlier in the first embodiment.

Step S62 determines whether the total delay time Tdd has elapsed after satisfaction of the execution condition of the purge control. Should the determination at Step S62 be "Yes", the process may then proceed to Step S70B. Should the determination at Step 62 be "No", the process may then proceed to Step S70C. The processes other than those performed at Steps S32 and S62 may be the same as in the first embodiment.

In this way, the second embodiment is different from the first embodiment in that Time T4(2) for initiating the reduction control of the fuel injection quantity of the injector 25A is counted starting from Time T1 (see FIG. 9) instead of Time T3(1) in FIG. 7 of the first embodiment. Therefore, the representative lines shown in the time chart of FIG. 9 are the same as those shown in the time chart of FIG. 7. Thus, the second embodiment may provide at least the same advantages as discussed earlier for the first embodiment. Further, fluctuation in the air-fuel ratio may be inhibited and/or minimized during the execution of the reduction control of the fuel injection quantity of the injector 25A in comparison with the comparative example shown in FIGS. 5 and 6. In addition, the time delay until the check valve 32V is opened from initiating the purge control may be shortened in comparison with the time delay discussed earlier in the comparative example.

Moreover, the second embodiment may be further modified in the same manner as described earlier in connection with the first embodiment. Thus, the purge valve 31V may be driven to open with the second duty ratio during only a part of the time between Time T1 and Time T3(2). Also, the second duty ratio (or the second opening degree) may be set to correspond to a maximum opening degree (i.e., fully opening degree) of the purge valve 31V. Alternatively, the second duty ratio (or the second opening degree) may be calculated or adjusted based on a difference between the intake passage pressure P(23) and the intermediate purge passage pressure P(32).

Further, the determination at Step S40 may be replaced with a determination whether the intermediate purge passage pressure P(32) is higher than the intake passage pressure P(23). In this case, should the intermediate purge passage pressure P(32) be higher than the intake passage pressure P(23) at Step S40, the process may proceed to Step S50B to make a change from the second duty ratio to the first duty ratio. Alternatively, the determination at Step S40 may be replaced with a determination whether a difference between the intermediate purge passage pressure P(32) and the intake passage pressure P(23) is smaller than a predetermined value. In such an instance, should the intermediate purge passage pressure P(32) be higher than the intake passage pressure P(23) at Step S40, the process may proceed to Step S50B to make a change from the second duty ratio to the first duty ratio.

The total delay time Tdd may be calculated as the sum of the predetermined time Tp and the arrival delay time Td. Accordingly, the total delay time Tdd may be longer than the arrival delay time Td and may be set to become longer as a difference between the intake passage pressure P(23) and the intermediate purge passage pressure P(32) increases. The total delay time Tdd may be referred to as an arrival delay time indicating a lag time until the fuel vapor arrives at the engine E from starting the purge control.

Also in the second embodiment, should the intermediate purge passage pressure P(32) be equal to or higher than the intake passage pressure P(23) at the time when the purge control is started, the predetermined time Tp may be set to be zero because the check valve 32V has already been opened. Thus, the purge valve 31V may not be driven to open with the second duty ratio during the purge control.

The purge control performed by the controller 40 according to the third embodiment will now be described with reference to a time chart shown in FIG. 11 and a flowchart shown in FIG. 12. In the first embodiment shown in FIGS. 7 and 8, the reduction of the fuel injection quantity of the injector 25A starts at Time T4(1) with reference to Time T3(1). The third embodiment differs from the first embodiment in that the reduction of the fuel injection quantity of the injector 25A starts at Time T3(3) when the arrival delay time Td has elapsed from time T1. In all other respects, the third embodiment may be the same as the first embodiment.

Figure 12:
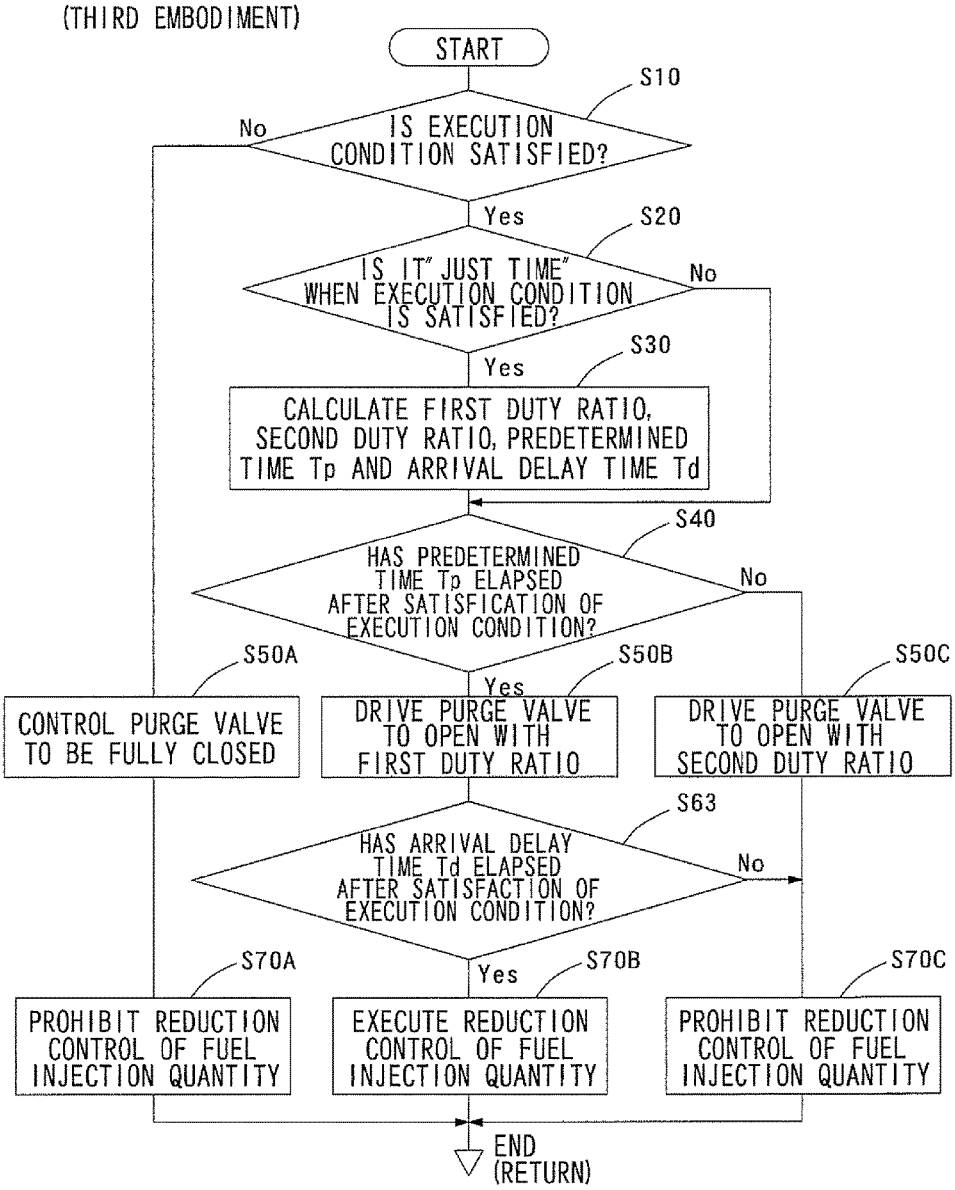
FIG. 12 is a flowchart illustrating a control process of the purge control performed by the fuel vapor supply system according to the third embodiment.

In detail, the flowchart shown in FIG. 12 differs from the flowchart shown in FIG. 8 in that Step S60 has been replaced with Step S63.

Step S63 may determine whether the arrival delay time Td has elapsed after satisfaction of the execution condition of the purge control, i.e., after Time T1. If the determination at Step S63 is "Yes", the process may proceed to Step S70B. If the determination at Step S63 is "No", the process may proceed to Step S70C. The processes other than those performed at Step S63 may be the same as shown in the first embodiment.

Figure 11:
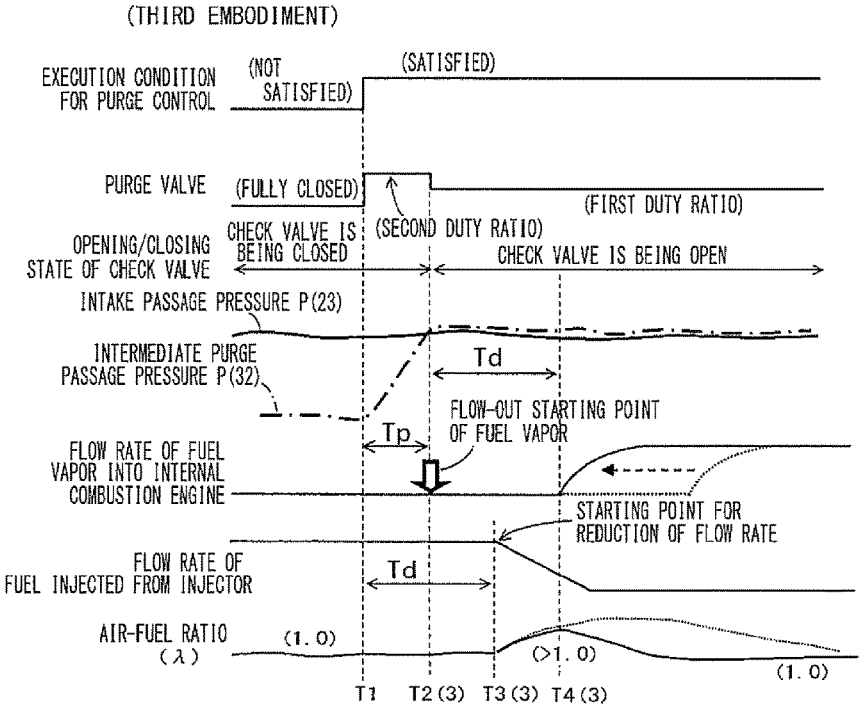
FIG. 11 is a time chart illustrating a purge control performed by a fuel vapor supply system according to a third embodiment.

As discussed herein, although Time T4(1) for starting the reduction control of the fuel injection quantity of the injector 25A may be the time when the total of the arrival delay time Td and the time Tp has elapsed from time T1 (see FIG. 7), Time T3(3) for starting the reduction control of in the third embodiment may be the time when the arrival delay time Td has elapsed from Time T1 (see FIG. 11). Therefore, as shown in FIG. 11, the reduction of the fuel injection quantity may be initiated at Time T3(3) shortly before time T4(3) that is the time when the flow of fuel vapor into the engine E starts. For this reason, the air-fuel ratio may slightly shift to the air excessive side between Time T3(3) and Time T4(3) and some period of time after Time T4(3). However, the purge valve 31V may be driven to open with the second duty ratio (or the second opening degree), which may be larger than the first duty ratio (or the first opening degree) when the purge control is initiated. Thus, the time lag (between Time T1 and Time T2(3)) until the check valve 32V is opened from starting the purge control may be shorter than the time lag in the comparative example shown in FIG. 6. As a result, the amplitude of fluctuation of the air-fuel ratio from the theoretical air-fuel ratio may be reduced in comparison with the comparative example as discussed earlier. In summary, the air-fuel ratio may be maintained within a predetermined range with respect to the theoretical air-fuel ratio. Furthermore, fluctuation in the air-fuel ratio may be shortened in comparison with the comparative example as discussed earlier.

Further, the third embodiment may be modified in the same manner as described in connection with the first embodiment. Thus, the purge valve 31V may be driven to open with the second duty ratio during, for example, only a part of the time between Time T1 and Time T2(3). Also, the second duty ratio (or the second opening degree) may be set to correspond to a maximum opening degree of the purge valve 31V. Alternatively, the second duty ratio (or the second opening degree) may be calculated and/or adjusted based on a difference between the intake passage pressure P(23) and the intermediate purge passage pressure P(32).

Further, the determination at Step S40 may be replaced with a determination of whether the intermediate purge passage pressure P(32) is higher than the intake passage pressure P(23). In such an instance, if the intermediate purge passage pressure P(32) is higher than the intake passage pressure P(23) at Step S40, the process may proceed to Step S50B for making a change from the second duty ratio to the first duty ratio. Alternatively, the determination at Step S40 may be replaced with a determination of whether a difference between the intermediate purge passage pressure P(32) and the intake passage pressure P(23) is smaller than a predetermined value. In this instance, should the intermediate purge passage pressure P(32) be higher than the intake passage pressure P(23) at Step S40, the process may proceed to Step S50B to make a change from the second duty ratio to the first duty ratio.

Also in the third embodiment, should the intermediate purge passage pressure P(32) be equal to or higher than the intake passage pressure P(23) at the time when the purge control is initiated, the predetermined time Tp may be set to zero since the check valve 32V is already opened. Therefore, the purge valve 31V may not be driven to open with the second duty ratio during the purge control.

Figure 13:
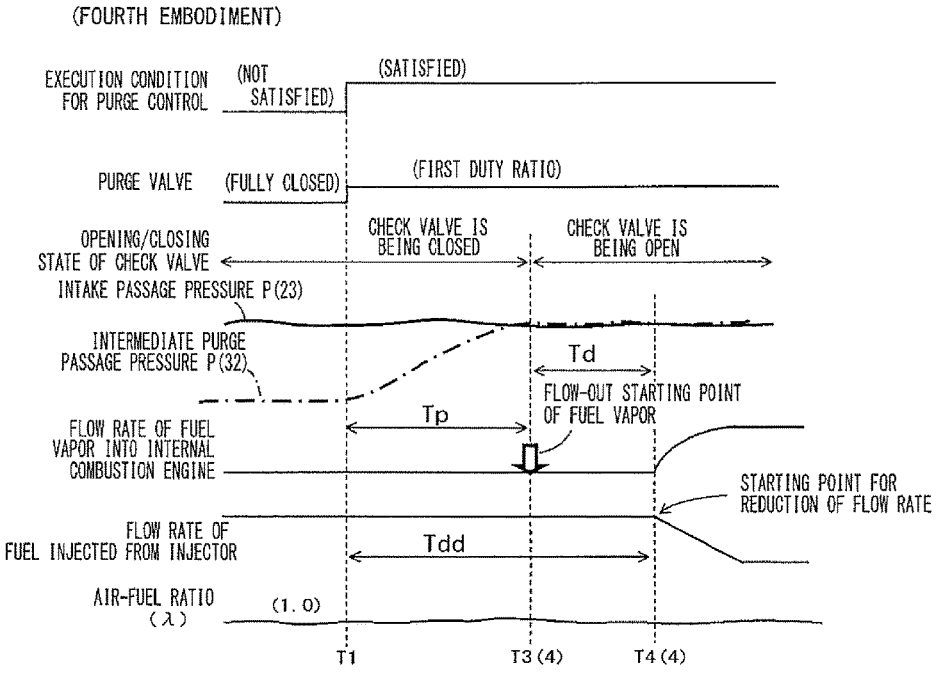
FIG. 13 is a time chart illustrating a purge control performed by a fuel vapor supply system according to a fourth embodiment.

The purge control performed by the controller 40 according to the fourth embodiment will now be described with reference to a time chart shown in FIG. 13 and a flowchart shown in FIG. 14. This embodiment is a modification of the second embodiment. Although the purge valve 31V may be driven to open with the second duty ratio between Time T1 and Time T3(2) as discussed in the second embodiment (see FIG. 9), the purge valve 31V may be driven to open with the first duty ratio between Time T1 and Time T3(4) that corresponds to Time T3(3). In other words, the purge valve 31V may be driven to open with the first duty ratio after time T1 without changing to the second duty ratio. This aspect will be described in further detail below.

Figure 14:
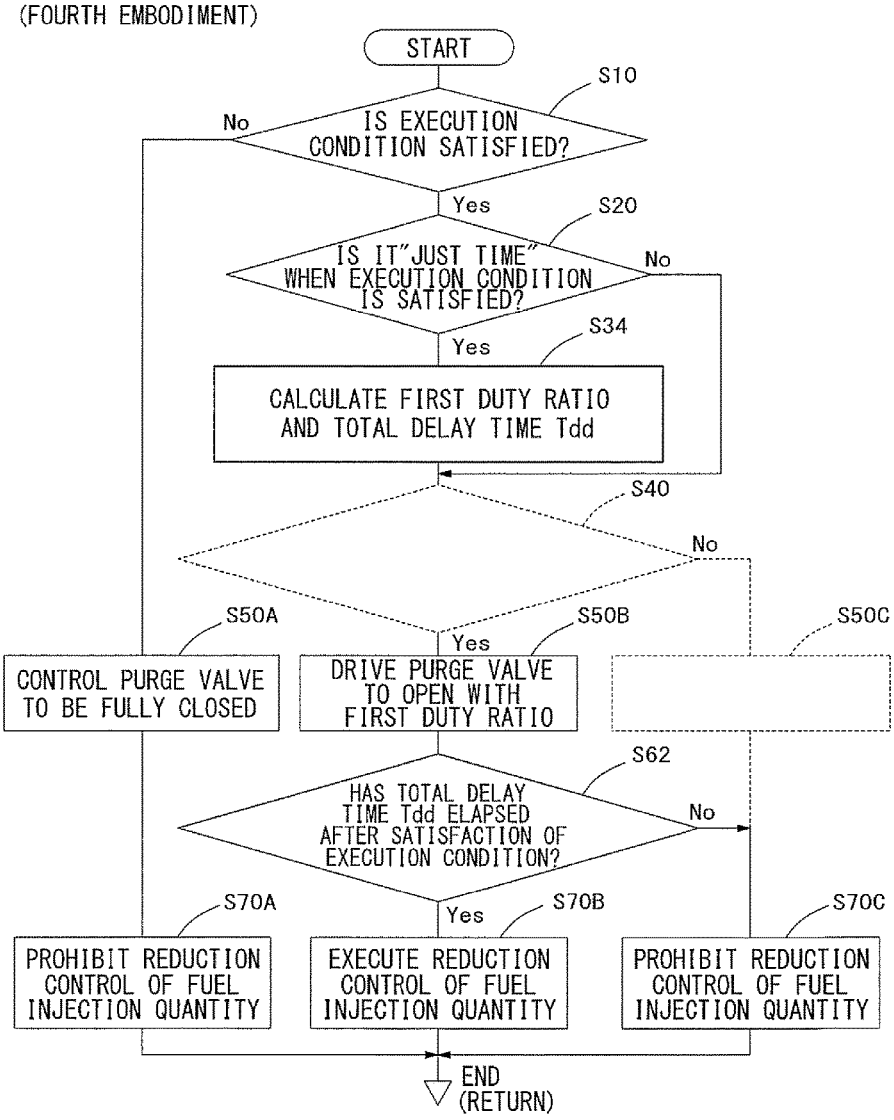
FIG. 14 is a flowchart illustrating a control process of the purge control performed by the fuel vapor supply system according to the fourth embodiment.

The flowchart shown in FIG. 14 differs from the flowchart shown in FIG. 10 in that Step S32 has been replaced with Step S34 and that Steps S40 and S50C are omitted.

Step S34 may calculate the first duty ratio and the total delay time Tdd. The process may then proceed to Step S50B. The total delay time Tdd may be calculated in the same manner as described for the second embodiment. The total delay time Tdd in the fourth embodiment may be longer than that described in the second embodiment, because the purge valve 31V may be driven to open with the first duty ratio after time T1, i.e., without first being changed to the second duty ratio. The processes other than the process performed at Step S34 may be the same as in the second embodiment.

As described above, in the case of the fourth embodiment, the total delay time Tdd may be longer than that discussed for the second embodiment. However, in the fourth embodiment, there may be no time lag between the time of starting the reduction of the fuel injection quantity of the injector 25A and the time of starting flow of the fuel vapor into the engine E, in contrast to the third embodiment that involves such a time lag. Accordingly, fluctuation of the air-fuel ratio may be reliably inhibited.

The process at Step S34 may be replaced with a process of calculating the first duty ratio, the predetermined time Tp and the arrival delay time Td. In such an instance, the process at Step S62 may be modified to determine whether the arrival delay time Td has elapsed after elapse of the predetermined time Tp from satisfaction of the execution condition of the purge control (i.e., from Time T1). Should the determination at Step S62 be "Yes", the process may then proceed to Step S70B. In contrast, should the determination at Step S62 be "No", the process may then proceed to Step S70C. Alternatively, the process at Step S62 may be modified to determine whether the arrival delay time Td has elapsed after the time when the intermediate purge passage pressure P(32) has exceeded the intake passage pressure P(23) (i.e., without considering whether the predetermined time Pd has elapsed). Otherwise, the process at Step S62 may be further modified to determine whether the arrival delay time Td has elapsed after a difference in pressure between the intake passage pressure P(23) and the intermediate purge passage pressure P(32) falls beneath a predetermined value (i.e., without considering whether or not the predetermined time Pd has elapsed).

Also in the fourth embodiment, should the intermediate purge passage pressure P(32) be equal to or exceed the intake passage pressure P(23) at the time when the purge control is initiated, the predetermined time Tp may be set to be zero because the check valve 32V has already been opened.

Figure 15:
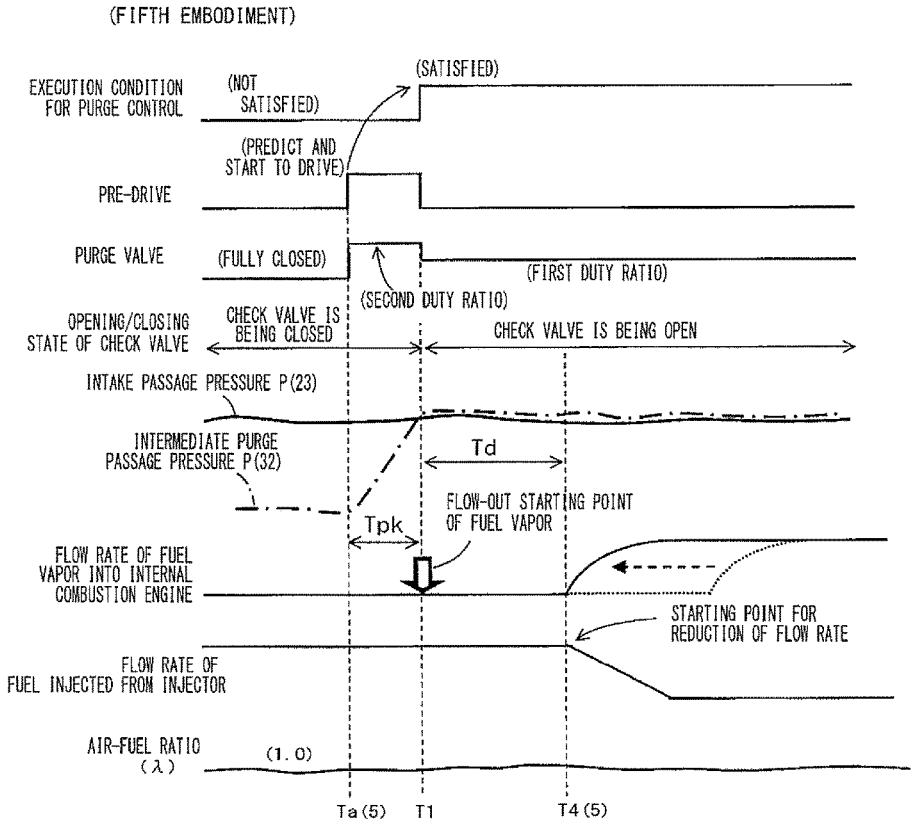
FIG. 15 is a time chart illustrating a purge control performed by a fuel vapor supply system according to a fifth embodiment.
Figure 16:
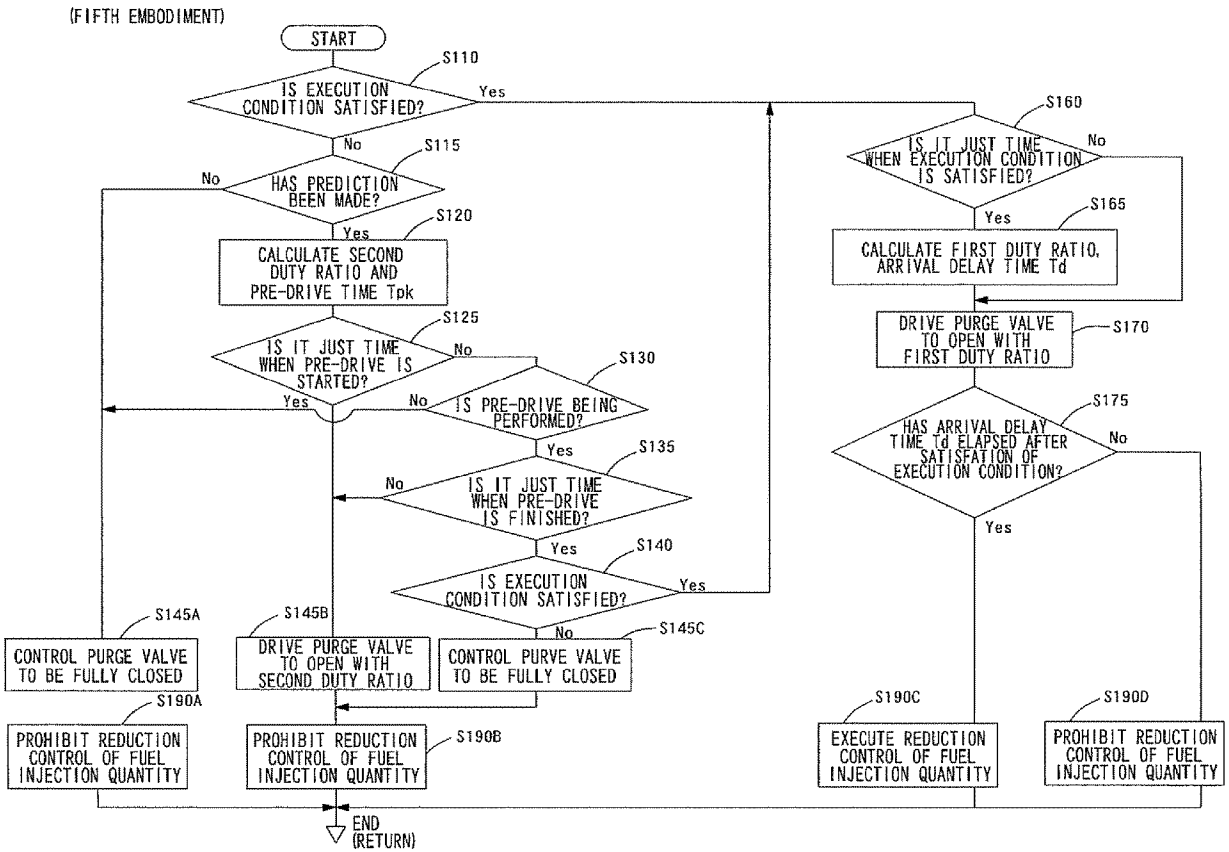
FIG. 16 is a flowchart illustrating a control process of the purge control performed by the fuel vapor supply system according to the fifth embodiment.

The purge control performed by the controller 40 according to the fifth embodiment will now be described with reference to a time chart shown in FIG. 15 and a flowchart shown in FIG. 16. The fifth embodiment differs from the first embodiment in that (a) the satisfaction of the execution condition of the purge control may be predicted, i.e. predicted at a time prior to the satisfaction of the execution condition of the purge control, and (b) the purge valve 31V may be driven to open with the second duty ratio immediately before execution of the purge control as a result of satisfaction of the execution condition, such that the intermediate purge passage pressure P(32) may be increased to cause opening of the check valve 32V at the time when the purge control is initiated. Similar to the comparative example, the controller 40 may periodically start the process of the flowchart shown in FIG. 16 at predetermined time intervals, such as intervals of 10 ms, or at a time point that corresponds to a predetermined crank angle, such as a crank angle of 180 degrees.

Step S110 may determine whether the execution condition for the purge control is satisfied. Should the execution condition be satisfied (i.e., "Yes") at Step 110, the process may proceed to Step S160. In contrast, should the execution condition not be satisfied (i.e., "No") at Step 110, the process may proceed to Step S115.

Step S115 may determine whether the prediction has been previously made with respect to the satisfaction of the execution condition of the purge control. Should the prediction have been previously made (i.e., "Yes" at Step S110), the process may proceed to Step S120. Should the prediction have not been made (i.e., "No" at Step S110), the process may proceed to Step S145A. For example, the execution condition of the purge control may be that both the following situations (a) and (b) have been met and maintained for a minimum a predetermined duration of time, such as 30 seconds. In an embodiment, the situation (a) may be that variation in the vehicle speed may fall within a predetermined rage, and the situation (b) may be that variation in the moving distance of an acceleration pedal operated by a driver falls within a predetermined range. In either of the discussed instances, the satisfaction of the execution condition may be predicted prior to execution of the process shown in FIG. 16. For example, the execution condition may be predicted as, for example, likely to be satisfied after 20 seconds from the time of execution of Step S115 of the process shown in FIG. 16.

Step S145A may fully close the purge valve 31V, and the process may then proceed to Step S190A. Step S190A may prohibit the reduction control of the fuel injection quantity of the injector 25A, and the process may then conclude to return to Step S110.

Step S120 may calculate a pre-drive second duty ratio (or a pre-drive second opening degree) and a pre-drive time Tpk, and the process may then proceed to Step S125. The pre-drive second duty ratio may be a duty ratio used for driving the purge valve 31V immediately before initiating the purge control and may be, for example, larger than the first duty ratio. The pre-drive time Tpk may be a time delay taken into account for an increase of the intermediate purge passage pressure P(32), which may become higher than the intake passage pressure P(23). The pre-drive time Tpk may be calculated based on the difference between the intake passage pressure P(23) and the intermediate purge passage pressure P(32), and/or the degree of opening of the purge valve (31V), etc.

Step S125 may determine whether the time for initiating a pre-drive operation has arrived. Should the determination at Step S125 be "Yes", the process may proceed to Step S145B. In contrast, should the determination at Step S125 be "No", the process may proceed to Step S130. The determination whether the time for initiating the pre-drive operation has arrived may be made depending on whether the process has reached a specified time, i.e., (Time Ta(5) in FIG. 15), prior to the predicted time with respect to satisfaction of the execution condition of the purge control by the pre-drive time Tpk.

Step S145B may drive the purge valve 31V to open with the pre-drive second duty ratio, and the process may then proceed to Step S190B.

Step S190B may prohibit the reduction control of the fuel injection quantity of the injector 25A, and the process may then conclude to return to Step S110.

Step S130 may determine whether the pre-drive operation has been performed. Should the determination at Step S130 be "Yes", the process may proceed to Step S135. Should the determination at S130 be "No", the process may proceed to Step S145A.

Step S135 may determine whether the "just time" has arrived when the pre-drive operation concludes. Should the determination at Step S135 be "Yes", the process may proceed to Step S140. Should the determination at Step S135 be "No", the process may proceed to Step S145B. Thus, the time when the pre-drive operation concludes may be determined to be the time when the pre-drive time Tpk has elapsed, i.e., after starting the pre-drive operation. In other embodiments, the time when the pre-drive operation concludes may be determined to be, for example, the time when the intermediate purge passage pressure P(32) has exceeded the intake passage pressure P(23), or the time when a difference between the intake passage pressure P(23) and the intermediate purge passage pressure P(32) falls beneath a predetermined value.

Step S140 may determine whether the execution condition for the purge control has been satisfied. Should the determination at Step S140 be "Yes", the process may proceed to Step S160. In contrast, should the determination at Step S140 be "No", the process may proceed to Step S145C.

Step S145C may control the purge valve 31V to be fully closed. The process may then proceed to Step S190, which may prohibit the reduction control of the fuel injection quantity of the injector 25A. Thereafter, the process may conclude and return to Step S110.

Step S160 may determine whether the "just time" has arrived when the execution condition is satisfied. Alternatively put, Step S160 may determine whether the "just time" of the change from unsatisfaction to satisfaction of the execution condition has occurred. Should the determination at Step S160 be "Yes", the process may proceed to Step S165. In contrast, should the determination at Step S160 be "No", the process may proceed to Step S170.

Step S165 may calculate the first duty ratio (or the first opening degree) and the arrival delay time Td, and the process may then proceed to Step S170. The first duty ratio may be a normally applied duty ratio of the purge valve 31V during the purge control. As described for the comparative example, the arrival delay time Td may be calculated from, for example, the number of rotations of the crankshaft 26C detected by the crank rotation detection device 26N. In other embodiments, the arrival delay time Td may be calculated from, for example, the flow rate of the intake air as detected by the flow rate detection device 10S, the degree of opening of the purge valve 31V, the pressure within the third intake passage 23 detected by the pressure detection device 24S (see FIG. 1, etc.)

Step S170 may drive the purge valve 31V to open with the first opening degree or the first duty ratio. Thereafter, the process may proceed to Step S175.

Step S175 may determine whether the arrival delay time Td has elapsed after satisfaction of the execution condition of the purge control. Should the determination at Step S175 be "Yes", the process may proceed to Step S190C. Should the determination at Step S175 be "No", the process may proceed to Step S190D.

Step S190C may perform a reduction control of the fuel injection quantity of the injector 25A, and the process may conclude to return to Step S110. In the time chart shown in FIG. 15, the fuel injection quantity of the injector 25A may be reduced to compensate for an increase in flow of the fuel into the engine E after Time T4(5) (i.e., after elapse of the arrival delay time Td from satisfaction of the execution condition of the purge control). Therefore, the fluctuation in the air-fuel ratio may be appropriately inhibited to maintain the theoretical air-fuel ratio ($\lambda$=1.0), or at a ratio near $\lambda$=1.0.

Step S190D may prohibit the reduction control of the fuel injection quantity of the injector 25A, and the process may then conclude to return to Step S110.

The second duty ratio (or the second opening degree) may be set to correspond to a maximum opening degree (i.e., fully open degree) of the purge valve 31V. Alternatively, the second duty ratio (or the second opening degree) may be calculated and/or adjusted based on a difference between the intake passage pressure P(23) and the intermediate purge passage pressure P(32). Further, the purge valve 31V may be opened with the first duty ratio (or the first opening degree) during the pre-drive operation.

The fifth embodiment described above may differ from the first to fourth embodiments in that the intermediate purge passage pressure P(32) may be increased to approach and/or exceed the intake passage pressure P(23) immediately prior to execution of the purge control. Thus, the time delay until the fuel vapor arrives at the engine E from starting the purge control may be appropriately reduced and/or minimized.

In the fifth embodiment, should the intermediate purge passage pressure P(32) be equal to or exceed the intake passage pressure P(23) at the time when the pre-drive operation is initiated, the pre-drive time Tpk may be set to be zero because the check valve 32V has already been opened. Thus, the purge valve 31V may not be driven to open with the second duty ratio during the purge control.

The first to fifth embodiment was described above for the configuration shown in FIG. 1, in which the pressure detection device 32S may be connected to and/or disposed in and/or on the intermediate purge passage 32, and the detection signal of the pressure detection device 32S may be used as the intermediate purge passage pressure P(32). However, the pressure detection device 32S may be omitted from the above-described configuration. In such an instance, the intermediate purge passage pressure P(32) may be estimated by using the intake passage pressure P(23). To this end, the controller 40 may perform an estimation process shown in FIG. 17 immediately prior to performing the control process in each of the first to fifth embodiments.

Figure 17:
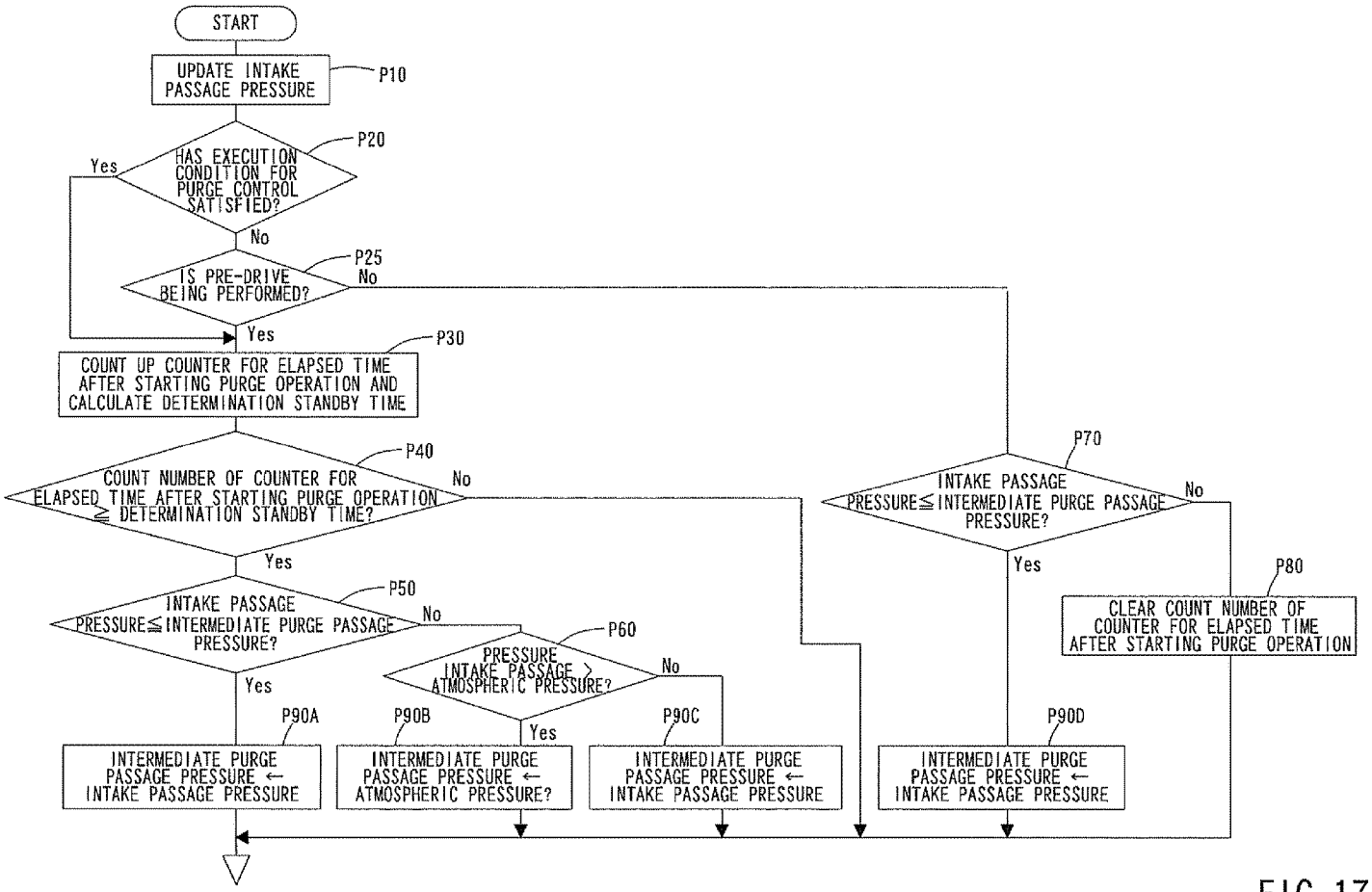
FIG. 17 is a flowchart illustrating an example of a control process for estimating the intermediate purge passage pressure based on the intake passage pressure without use of a pressure detection device for detecting the intermediate purge passage pressure.

The estimation process introduced above will now be described in further detail with reference to FIG. 17. In FIG. 17, Step P10 may update the intake passage pressure P(23) based on the detection signal from the pressure detection device 24S shown in FIG. 1. After updating the intake passage pressure P(23) as described here, the process may proceed to Step P20.

Step P20 may determine whether the execution condition of the purge control has been satisfied. Should the determination at Step P20 be "Yes", the process may proceed to Step P30. Should the determination at Step P20 be "No", the process may proceed to Step P25. In the instance of the first to fourth embodiments that do not include the pre-drive operation, Step P25 may be omitted. Therefore, in the case of the first to fourth embodiments, should the determination at Step P20 be "Yes", the process may proceed to Step P30. In contrast, should the determination at Step P20 be "No", the process may proceed to Step P70. Alternatively put, in the case of the first to fourth embodiments, the process may proceed to Step S70 should the purge valve 31V be fully closed. In comparison, the process may proceed to Step S30 should the purge valve 31V be, for example, at least partially open.

Step P25 may determine whether the pre-drive operation has been performed. Should the determination at Step P25 be "Yes", the process may proceed to Step P30. In contrast, should the determination at Step P25 be "No", the process may proceed to Step P70.

Step P30 incrementally tracks, i.e. "counts up" via a "count up counter" the time elapsed after initiating the purge operation and calculates a determination standby time that may correspond to a pressure variation transition period. The pressure variation transition period may be a period during which the intermediate purge passage pressure P(32) tends to increase. After that described above has passed, the process may proceed to Step P40. The determination standby time may be calculated based on a difference between the intake passage pressure and the intermediate purge passage pressure (as obtained by the previous cyclic process). In alternative embodiments, the determination standby time may be calculated based on the degree of opening of the purge valve 31V, etc., at the time of control of the purge valve 31V for opening with a certain opening degree, or a certain duty ratio different from that of the fully closed state of the purge valve 31V.

Step P40 may determine whether the time corresponding to the counted value of the counter exceeds the determination standby time. Should the determination at Step P40 be "Yes", the process may proceed to Step P50. In contrast, should the determination at Step P40 be "No", the process may conclude and return to Step P10.

Step P50 may determine whether the intake passage pressure P(23) is equal to or less than the intermediate purge passage pressure P(32). Should the determination at Step P50 be "Yes", the process may proceed to Step P90A. In contrast, should the determination at Step P50 be "No", the process may proceed to Step P60.

Step P90A may assign a value of the intake passage pressure to the value of the intermediate purge passage pressure, and the process may then conclude to return to Step P10.

Step P60 may determine whether the intake passage pressure P(23) exceeds the atmospheric pressure. Should the determination at Step P60 be "Yes", the process may proceed to Step P90B. In contrast, should the determination at Step P60 be "No", the process may proceed to Step P90C.

Step P90B may assign the value of the atmospheric pressure to the value of the intermediate purge passage pressure, and the process may then conclude to return to Step P10.

Step P90C may assign the value of the intake passage pressure P(23) to the value of the intermediate purge passage pressure, and the process may then conclude to return to Step P10.

Should the process proceed from Step P25 to Step P70, the controller 40 may determine at Step P70 whether the intake passage pressure P(23) is lower than or equal to the intermediate purge passage pressure P(32). Should the determination at Step P70 be "Yes", the process may proceed to Step P90D. In contrast, should the determination at Step P70 be "No", the process may proceed to Step P80.

Step P90D may assign the value of the intake passage pressure P(23) to the value of the intermediate purge passage pressure P(32), and the process may then conclude to return to Step P10.

Step P90D may clear the count of the counter for the time after initiating the purge operation, and the process may then conclude to return to Step P10.

With regard to the process described above, should the purge control not be performed (or should the purge valve 31V be fully closed when the pre-drive operation is not performed), the smallest value of the detected values of the intake passage pressure P(23) may be used as the value of the intermediate purge passage pressure P(32). Alternatively, should the purge control be performed (or if the purge valve 31V is opened in the state that the pre-drive operation is performed), the intake passage pressure P(23) may be used as the intermediate purge passage pressure P(32) as long as the intake passage pressure is equal to or less than the atmospheric pressure after elapse of the determination standby time (i.e., after elapse of the transition period during which the intermediate purge passage pressure P(32) tends to increase). Thus, in accordance with the configuration described above, the pressure detection device 32S may not be necessary. As a result, the number of components of the fuel vapor supply system may be reduced and/or minimized.

The above embodiments may be further modified in various ways. In detail, the flowcharts shown in FIGS. 8, 10, 12, 14, 15 and 17 may be further modified in various ways. Moreover, the time charts shown in FIGS. 7, 9, 11, 13 and 15 may be also further modified.

Further, although the above embodiments have been described in association with the fuel vapor supply system for use with, for example, the vehicle engine E, the teachings of the above disclosure may be adapted and/or applied to engines other than that used to provide power to a vehicle.

Moreover, the relative mathematical expressions such as "not less than (≥)," "not more than (≤)," "more than (>)," and "less than (<)" may or may not be shown with an equal sign. Also, the numerical values disclosed in the description of the above embodiments are only given by way of example, and should thus not be construed restrictively.

Representative, non-limiting examples were described above in detail with reference to the attached drawings. The detailed description is intended to teach a person of skill in the art details for practicing aspects of the present teachings and thus is not intended to limit the scope of the invention. Furthermore, each of the additional features and teachings disclosed above may be applied and/or utilized separately or in conjunction with other features and teachings to provide improved fuel supply systems, and methods of making and using the same.

Moreover, the various combinations of features and steps disclosed in the above detailed description may not be necessary to practice the invention in the broadest sense, and are instead taught to describe representative examples of the invention. Further, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed as informational, instructive and/or representative and may thus be construed separately and independently from each other. In addition, all value ranges and/or indications of groups of entities are also intended to include possible intermediate values and/or intermediate entities for the purpose of original written disclosure, as well as for the purpose of restricting the claimed subject matter.

What is claimed is:

1. A fuel vapor supply system configured to supply fuel vapor to an internal combustion engine having an intake passage and a fuel injector, the fuel vapor supply system comprising:

a canister configured to store the fuel vapor;

a purge passage extending from the canister to connect to the intake passage of the internal combustion engine wherein the purge passage allows the fuel vapor stored in the canister to flow to the internal combustion engine through the purge passage;

a purge valve disposed in the purge passage wherein the purge valve is configured to regulate a flow rate of the fuel vapor flowing from the canister to the intake passage;

a check valve disposed in the purge passage between the purge valve and the intake passage wherein the check valve is configured to permit the flow of the fuel vapor from the canister to the intake passage and further wherein the check valve is configured to prevent the flow of air from the intake passage to the canister;

wherein the purge passage has an intermediate purge passage that extends from the purge valve to the check valve; and a controller coupled with the purge valve and the fuel injector, wherein the controller is configured to:

control a degree of opening of the purge valve or control a duty ratio wherein the duty ratio is defined as a ratio of a valve opening time to a predetermined frequency period and further wherein control of the degree of opening of the purge valve or control of the duty ratio regulates the flow rate of the fuel vapor flowing across the purge valve;

perform a purge control and perform a reduction control of a fuel injection quantity of fuel injected from the injector, wherein the purge control is defined as an operation that controls the purge valve to open with a first opening degree or a first duty ratio such that the fuel vapor stored in the canister flows from the canister to the internal combustion engine via the purge passage and the intake passage because of a negative pressure in the intake passage wherein the negative pressure is defined as a pressure less than an atmospheric pressure, while the fuel vapor flows across the purge valve, through the intermediate purge passage, and across the check valve in the purge passage, wherein the reduction control is defined as an operation that begins when a predetermined arrival delay time has elapsed from starting the purge control wherein the reduction control regulates the fuel injector such that a quantity fuel injected by the fuel injector is reduced to compensate for a quantity of the fuel vapor supplied to the internal combustion engine; and wherein the controller is further configured to:

determine whether a predetermined execution condition for the purge control is satisfied;

predict an execution condition satisfaction time when the predetermined execution condition for the purge control will be satisfied wherein the prediction of the execution condition satisfaction time is performed prior to the determination of whether the predetermined execution condition is satisfied;

determine whether the execution condition satisfaction time has been predicted, wherein the determination is performed if the predetermined execution condition is not satisfied;

perform a pre-drive operation in which the purge valve is open with the first opening degree or the first duty ratio or with a second opening degree larger than the first opening degree or a second duty ratio larger than the first duty ratio wherein the pre-drive operation is performed after the execution condition satisfaction time has been predicted and further wherein the pre-drive operation is initiated at a start time before the execution condition satisfaction time by a predetermined pre-drive time;

control the purge valve to open with the first opening degree or the first duty ratio if the predetermine execution condition is satisfied; and prevent the reduction control during the pre-drive operation.

2. The fuel vapor supply system according to claim 1, further comprising one of either a pressure detection device disposed within the intermediate purge passage for detecting a pressure within the intermediate purge passage, or the controller is further configured to estimate the pressure within the intermediate purge passage based on a pressure within the intake passage, and wherein the controller is further configured to determine the pre-drive time based on a difference between the pressure within the intake passage and the pressure within the intermediate purge passage at a time when the prediction of the execution condition satisfaction time is made.

3. The fuel vapor supply system according to claim 1, further comprising one of either a pressure detection device disposed within the intermediate purge passage for detecting a pressure within the intermediate purge passage, or the controller is further configured to estimate the pressure within the intermediate purge passage based on a pressure within the intake passage, and wherein the controller is further configured to terminate the pre-drive operation at a time when the predetermined pre-drive time has elapsed, when a difference between the pressure within the intake passage and the pressure within the intermediate purge passage falls beneath a predetermined value, or when the pressure within the intermediate purge passage exceeds the pressure within the intake passage.

4. The fuel vapor supply system according to claim 1, wherein the second opening degree corresponds to a maximum opening degree of the purge valve and the second duty ratio corresponds to a maximum duty ratio.

5. The fuel vapor supply system according to claim 1, further comprising one of either a pressure detection device disposed within the intermediate purge passage for detecting a pressure within the intermediate purge passage, or the controller is further configured to estimate the pressure within the intermediate purge passage based on a pressure within the intake passage, and wherein the controller is further configured to adjust a value of the second opening degree or the second duty ratio according a difference between the pressure within the intake passage and the pressure within the intermediate purge passage.

6. The fuel vapor supply system according to claim 1, wherein:

the fuel vapor supply system further comprises a pressure detection device configured to detect the pressure within the intake passage;

the fuel vapor supply system further comprises one of either a pressure detection device disposed within the intermediate purge passage for detecting a pressure within the intermediate purge passage, or the controller is further configured to estimate the pressure within the intermediate purge passage based on a pressure within the intake passage;

the controller is further configured to estimate the pressure within the intermediate purge passage;

wherein the controller estimates the pressure within the intermediate purge passage to be equal to a smallest value of detected values of the pressure within the intake passage should the purge valve be fully closed; and wherein the controller estimates the pressure within the intermediate purge passage to be equal to the pressure within the intake passage detected at a time when a predetermined pressure variation transition time has elapsed after starting the purge control should the purge valve not be fully closed.

7. The fuel vapor supply system according to claim 6, wherein the controller is further configured to adjust a duration of the predetermined pressure variation transition time based on a difference between the pressure within the intake passage detected by the pressure detection device and the pressure within the intermediate purge passage estimated when the purge valve is fully closed.

8. The fuel vapor supply system according to claim 6, wherein the controller estimates the pressure within the intermediate purge passage to be equal to the atmospheric pressure provided that the pressure within the intake passage is higher than the atmospheric pressure at the time when the predetermined pressure variation transition time has elapsed after initiating the purge control should the purge valve not be fully closed.

* * * * *